US006851995B2

(12) United States Patent
Takegami et al.

(10) Patent No.: US 6,851,995 B2
(45) Date of Patent: Feb. 8, 2005

(54) METHOD OF MANUFACTURING AN ELECTRON SOURCE

(75) Inventors: Tsuyoshi Takegami, Tokyo (JP); Hisaaki Kawade, Kanagawa (JP); Takahiro Oguchi, Kanagawa (JP); Kazuhiro Jindai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 10/254,507

(22) Filed: Sep. 26, 2002

(65) Prior Publication Data

US 2003/0064653 A1 Apr. 3, 2003

(30) Foreign Application Priority Data

Sep. 28, 2001 (JP) ..... 2001-304612

(51) Int. Cl.[7] ..... H01J 9/00; H01J 9/42; H01J 9/44

(52) U.S. Cl. ..... 445/6; 445/3; 445/5; 315/169.1; 315/169.2; 345/55; 345/74; 345/75; 345/78

(58) Field of Search ..... 445/3, 5, 6; 315/169.1, 315/169.2; 345/55, 76, 78, 74

(56) References Cited

U.S. PATENT DOCUMENTS

| | | | | |
|---|---|---|---|---|
| 6,053,791 | A | 4/2000 | Fujii et al. | 445/6 |
| 6,063,453 | A | 5/2000 | Tomida et al. | 427/532 |
| 6,288,485 | B1 | 9/2001 | Takegami et al. | 313/495 |
| 6,334,801 | B1 | 1/2002 | Kawade et al. | 445/24 |
| 6,346,773 | B1 | 2/2002 | Takegami | 315/169.1 |
| 6,445,367 | B1 | 9/2002 | Suzuki et al. | 345/75.2 |
| 6,490,433 | B1 | 12/2002 | Kawade | 455/6 |
| 6,534,924 | B1 | 3/2003 | Oguchi et al. | 315/169.1 |

FOREIGN PATENT DOCUMENTS

| | | | |
|---|---|---|---|
| EP | 948022 A2 * | 10/1999 | H01J/9/02 |
| EP | 0 964 421 | 12/1999 | H01J/9/02 |
| JP | 2000-3087849 | 7/2000 | H01J/9/02 |
| JP | 2000-311593 | 11/2000 | H01J/9/02 |

OTHER PUBLICATIONS

W. P. Dyke et al., "Field Emission,", Advances in Electronics and Electron Physics, vol. 8 (1956) pp. 89–185.

C. A. Spindt et al., "Physical Properties of Thin–Film Field Emission Cathodes with Molybd num Cones," *Journal of Applied Physics*, vol. 47, No. 12 (1976) pp. 5248–5263.

Hisashi Araki et al., "Electroforming and Electron Emission of Carbon Thin Films," Journal of th Vacuum Society of Japan, 1983 (with English Abstract on p. 22).

M. Hartwell et al., "Strong Electron Emission from Patterned Tin–Indium Oxide Thin Films," IEEE Trans. Ed. Conf., (1983) pp. 519–521.

G. Dittmer, "Electrical Conduction and Electron Emission of Discontinuous Thin Films," *Thin Solid Films*, vol. 9 (1972) pp. 317–329.

M. I. Elinson et al., "The Emission of Hot Electrons and the Field Emission of Electrons from Tin Oxide," *Radio Engineering and Electronic Physics* (1965) pp. 1290–1296.

C. A. Mead, "Operation of Tunnel–Emission Devices," *Journal of Applied Physics*, vol. 32, N. 4 (1961), pp. 646–652.

* cited by examiner

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

It relates to a method of manufacturing an electron source. In an activation process, a set value of an activation gas partial pressure is switched at multi-stages and an application of a compensation voltage is not conducted for a predetermined period after switching of the set value. Alternatively, the activation is repeated plural times while a row wiring or a column wiring is switched, and the application of the compensation voltage is not conducted for the predetermined period after switching of the row wiring or the column wiring. Thus, activation processing can be uniformly performed for all electron emitting devices.

15 Claims, 27 Drawing Sheets

METHOD OF MANUFACTURING AN ELECTRON SOURCE

BACKGROUND OF THE INVENTION

1. Field of the Invention

The present invention relates to a method of manufacturing an electron source including an activation process.

2. Description of the Related Art

Electron-emitting devices heretofore known are generally grouped into two types: a thermionic emission type and a cold-cathode electron emission type.

Known examples of the cold-cathode electron-emitting devices include, surface conduction electron-emitting devices, field-emission (hereafter referred to as FE-type) devices, and metal-insulating layer-metal (hereafter referred to as MIM-type) devices.

For example, an FE-type device, such as the one disclosed by W. P. Dyke and W. W. Dolan in "Field Emission", Advance in Electron Physics, 8,89 (1956), or the one disclosed by C. A. Spindt in "Physical Properties of Thin-film Field Emission Cathodes with Molybdenum Cones", J. Appl. Phys., 47, 5248 (1976), is known.

Also, An MIM-type device, such as the one disclosed by C. A. Mead in "Operation of Tunnel-Emission Devices", J. Apply. Phys., 32,646 (1961), is known.

An example of the surface conduction electron-emitting device is reported by M. I. Elinson in Radio Eng. Electron Phys., 10, 1290, (1965), and other examples thereof described below are known.

The surface conduction electron-emitting device uses a phenomenon where electrons are emitted when an electric current is allowed to flow in parallel to the surface of a thin film that has a small area and is formed on a substrate. While Elinson proposes the use of an $SnO_2$ thin film for the surface conduction electron-emitting device, the use of an Au thin film (G. Dittmer, Thin Solid Films, 9, 317 (1972)), the use of an $In_2O_3/SnO_2$ thin film (M. Hartwell and C. G. Fonstad, IEEE Trans. ED Conf., 519 (1975)) and the use of carbon thin film (Hisashi ARAKI, et al.: SHINKU (Vacuum), Vol.26 No.1, p.22(1983)), are also proposed.

According to the above surface conduction type electron-emitting device represented by the device of M. Hartwell et al., generally, energization processing which is called energization forming is performed for the above thin film (conductive thin film) before electron emission to form an electron emitting portion.

That is, in the energization forming, a predetermined direct current voltage, or a direct current voltage which is raised at a very slow rate of, for example, about 1 [V/minute] is applied to both ends of a conductive thin film to supply a current thereto. Thus, the conductive thin film is locally broken, deformed, or altered, thereby forming an electron emitting portion having an electrically high resistance state.

Then, a crack is caused in a portion of the conductive thin film which is locally broken, deformed, or altered. When a suitable voltage is applied to the conductive thin film after the energization forming, electron emission is conducted in the vicinity of the crack.

Also, according to JP 3087849 B made by the present inventor(s), an activation process of a plurality of surface conduction type emitting devices is described in detail as a process for improving the number of electrons to be emitted.

The energization activation process is processing which is performed for the electron emitting devices after the completion of energization forming processing. Specifically, the application of a predetermined pulse voltage is repeated under an environment having the degree of vacuum of about $1\times10^{-2}$ Pa to $1\times10^{-3}$ Pa in which an organic substance is present. Thus, carbon or a carbon compound is deposited on the electron emitting portion formed by the forming. Accordingly, an emission current from the above devices is markedly increased.

As described in JP 3087849 B described above, wirings for connecting between the plurality of electron emitting devices have a slight resistance value. Thus, when a large size matrix panel or the like is used, a wiring resistance cannot be neglected and the energization activation process is influenced thereby. Therefore, in JP 3087849 B, it is indicated that a voltage compensation method of applying voltages from column directional wirings to compensate the influence of voltage drop by row directional wirings is effective.

However, in the case of the above conventional technique, the following improvement is required.

As an electron source plate composed of a large number of electron emitting devices, there is given an electron source substrate having a simple matrix structure in which electron emitting devices are arranged in a matrix shape with, for example, M rows and N columns. When the above energization activation process is performed for such a substrate, a voltage is applied to a common wiring for M rows and N columns which is connected with device electrodes.

However, when the energization activation process is performed for the above electron source substrate having the simple matrix structure, there is the case where an unevenness in electron emitting characteristics is caused. As the causes, there are given a variation in activation gas atmosphere and the influence of a wiring resistance by a matrix wiring. The present inventor(s) have concentratedly studied a method of eliminating these causes.

As a result, when the influence of the variation in activation gas atmosphere is eliminated, it is found that a method of dividing the energization activation process into a plurality of processes of at least two stages to eliminate the influence of the activation gas atmosphere (described later in detail) is effective.

Also, when the influence of the wiring resistance by the matrix wiring is eliminated, it is found that an energization method of compensating the influence of voltage drop (described later in detail) is effective.

However, when the above method of eliminating the influence of the variation in activation gas atmosphere and the above method of eliminating the influence of the wiring resistance by the matrix wiring are simultaneously used, a further variation in electron emitting characteristics is caused. Thus, when these methods are simultaneously used for the method of canceling a variation in electron emitting characteristics, there is an insufficient point.

A matter to be solved by the present invention in the application is this point.

SUMMARY OF THE INVENTION

According to the present invention, there is provided a method of manufacturing an electron source including a plurality of row wirings, a plurality of column wirings, and a plurality of electron emitting devices each connected therewith, which are provided on a substrate, the method including:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, characterized in that:

the activation step has a compensation voltage applying step of selecting part of either one of the row wirings and the column wirings, and determining a potential of the selected wiring so that, when the voltage is applied to all the electron emitting devices connected with the selected wiring, a compensation voltage for compensating voltage drop caused in the selected wiring is applied to the electron emitting devices connected with the selected wiring through another of the row wirings and the column wirings; and in the compensation voltage applying step, operation for limiting the compensation voltage applied to the electron emitting devices connected with the selected wiring for a predetermined period is conducted.

The operation for limiting the compensation voltage applied to the electron emitting devices for the predetermined period is preferably conducted by controlling the compensation voltage.

Alternatively, it is preferable that in the operation for limiting the compensation voltage applied to the electron emitting devices for the predetermined period, the compensation voltage is set to a value smaller than a normally compensated voltage.

Alternatively, it is preferable that in the operation for limiting the compensation voltage applied to the electron emitting devices for the predetermined period, the compensation voltage is set to 0.

Alternatively, it is preferable that in the operation for limiting the compensation voltage applied to the electron emitting devices for the predetermined period, the compensation voltage is set to a predetermined value.

Alternatively, it is preferable that in the operation for limiting the compensation voltage applied to the electron emitting devices for the predetermined period, the compensation voltage is set to a value calculated from a value of a current flowing through the electron emitting devices which is measured in advance.

The predetermined period preferably includes a period during which a device current of the electron emitting devices which is measured in advance is decreased.

Alternatively, it is preferable that the predetermined period includes a period during which a time differential value of a device current of the electron emitting devices is negative.

The compensation voltage is preferably determined based on a variation in activation gas partial pressure.

Also, according to the present invention, there is provided a method of manufacturing an electron source including a plurality of row wirings, a plurality of column wirings, and a plurality of electron emitting devices each connected therewith, which are provided on a substrate, the method including:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, characterized in that:

the activation step has a compensation voltage applying step of selecting part of either one of the row wirings and the column wirings, and determining a potential of the selected wiring so that, when the voltage is applied to all the electron emitting devices connected with the selected wiring, a compensation voltage for compensating voltage drop caused in the selected wiring is applied to the electron emitting devices connected with the selected wiring through another of the row wirings and the column wirings, and a step for switching at multi-stages a set value of an activation gas partial pressure; and in the compensation voltage applying step, an application of the compensation voltage is not conducted for a predetermined period after switching of the set value.

Also, according to the present invention, there is provided a method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, characterized in that:

the activation step has a compensation voltage applying step of selecting part of either one of the row wirings and the column wirings, and determining a potential of the selected wiring so that, when the voltage is applied to all the electron emitting devices connected with the selected wiring, a compensation voltage for compensating voltage drop caused in the selected wiring is applied to the electron emitting devices connected with the selected wiring through another of the row wirings and the column wirings; and the compensation voltage applying step is repeated plural times while the selected wiring is switched and an application of the compensation voltage is not conducted for a predetermined period after switching of the selected wiring.

The compensation voltage is preferably calculated based on a measurement value of a current flowing through the selected wiring.

Also, according to the present invention, there is provided a method of manufacturing an electron source including a plurality of row wirings, a plurality of column wirings, and a plurality of electron emitting devices each connected therewith, which are provided on a substrate, the method including:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, characterized in that:

the activation step has a compensation voltage applying step of selecting part of either one of the row wirings and the column wirings, and determining a potential of the selected wiring so that, when the voltage is applied to all the electron emitting devices connected with the selected wiring, a compensation voltage for compensating voltage drop caused in the selected wiring is applied to the electron emitting devices connected with the selected wiring through another of the row wirings and the column wirings; and in the compensation voltage applying step, operation for limiting a potential applied to the selected wiring for a predetermined period is conducted.

DETAILED DESCRIPTION OF THE PREFERRED EMBODIMENTS

Figure 1:
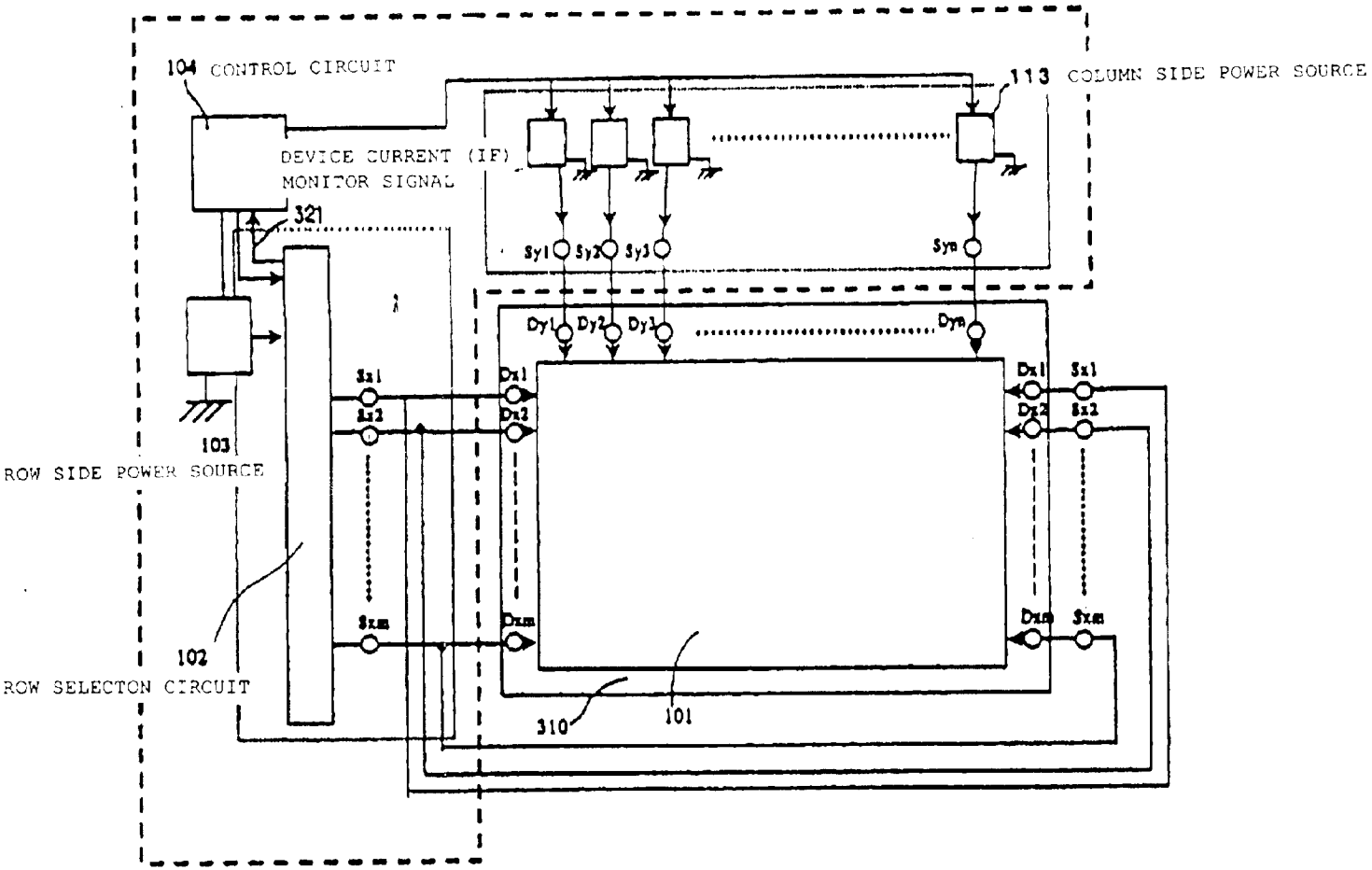
FIG. 1 is a schematic diagram of an energization activation process apparatus.

Hereinafter, first, "the method of eliminating the influence of the wiring resistance by the matrix wiring" and "the method of eliminating the influence of a variation in activation gas atmosphere" which are described above will be described. Next, an insufficient point which is a problem to be solved by the invention in the present application in the case where these methods are combined will be described.

"The method of eliminating the influence of the wiring resistance by the matrix wiring" will be described.

Here, an energization activation process which is performed for an electron source having a simple matrix structure will be described before the description of the method of eliminating the influence of the wiring resistance by the matrix wiring.

Here, a method of performing energization activation in units of row wiring will be described with reference to FIG. 16.

In the drawing, reference numeral 74 denotes a surface conduction type emitting device which is schematically indicated, 72 denotes a row wiring, and 73 denotes a column wiring. The row wiring 72 and the column wiring 73 each have a finite electrical resistor 78. Such a wiring method is called simple matrix wiring.

In this drawing, the case where a voltage is applied to a second row wiring (DX2) is shown. In order to apply the voltage to the second row wiring, all column directional wirings are set to GND and a voltage is supplied from a second row power source 79. In addition, a value of a device current flowing into the row wiring DX2 is measured by an ammeter 76.

Figure 17:
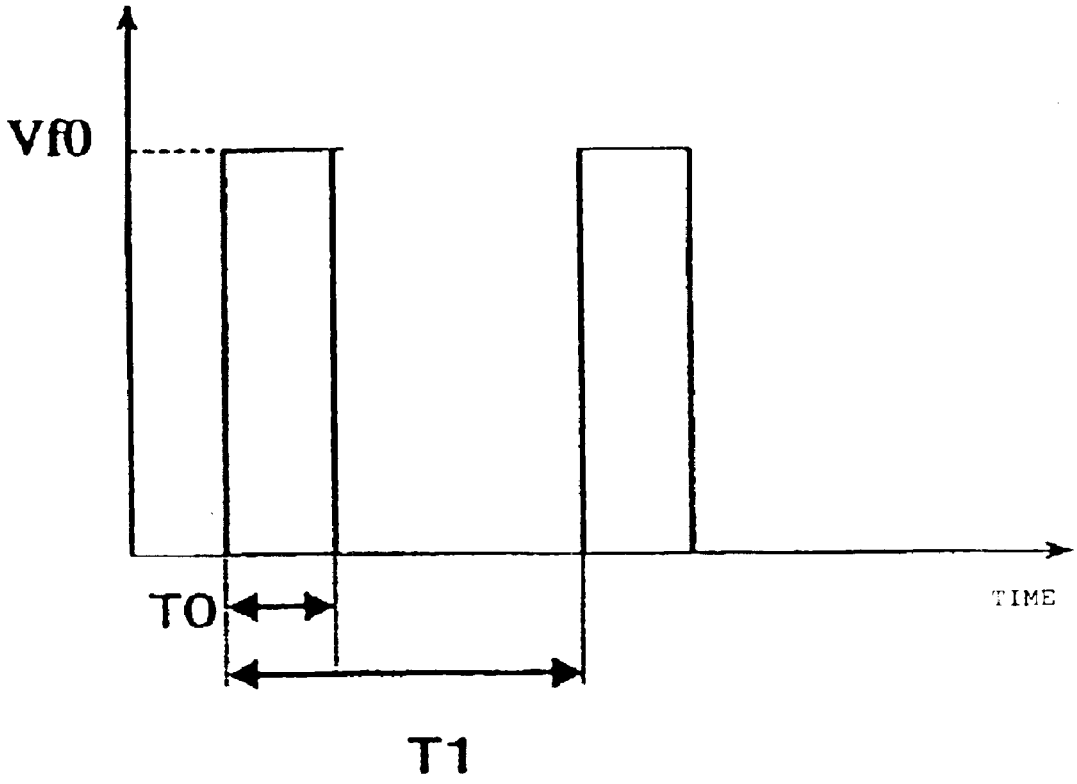
FIG. 17 shows a voltage waveform used for energization in activation processing.

FIG. 17 shows a voltage waveform used for energization. The energization activation is conducted using a pulse waveform. Here, the case where a rectangular pulse is used as the pulse waveform is indicated. In this drawing, it is shown that the pulse waveform is a rectangular pulse having a pulse width T0 and a pulse interval T1.

Thus, with respect to the electron source having the simple matrix structure, the energization is performed in units of row wiring.

However, when such energization activation is performed for a large size electron source in which wirings are connected in matrix, there is a problem in that an unevenness in electron emitting characteristics is caused in accordance with device positions. This is because a voltage applied to a device located in a matrix end portion is different from that applied to a device located in a matrix central portion by the influence of voltage drop by the wring resistance.

Figure 18:
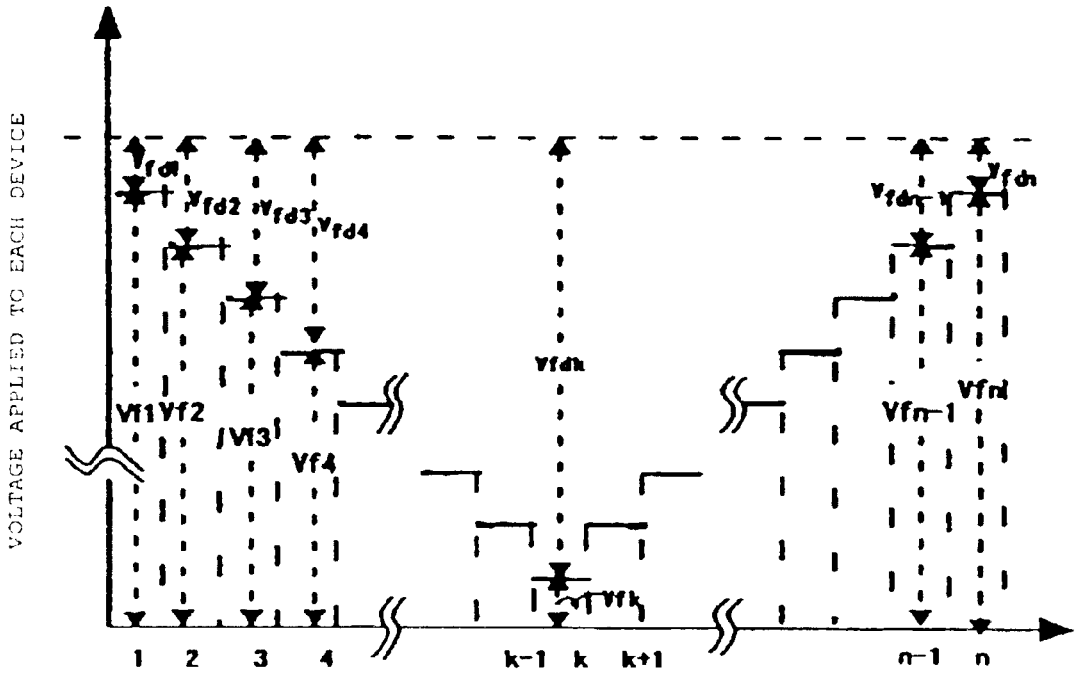
FIG. 18 schematically shows a state of voltage drop in a matrix wiring.

FIG. 18 schematically shows a state of voltage drop in matrix wiring.

Figure 16:
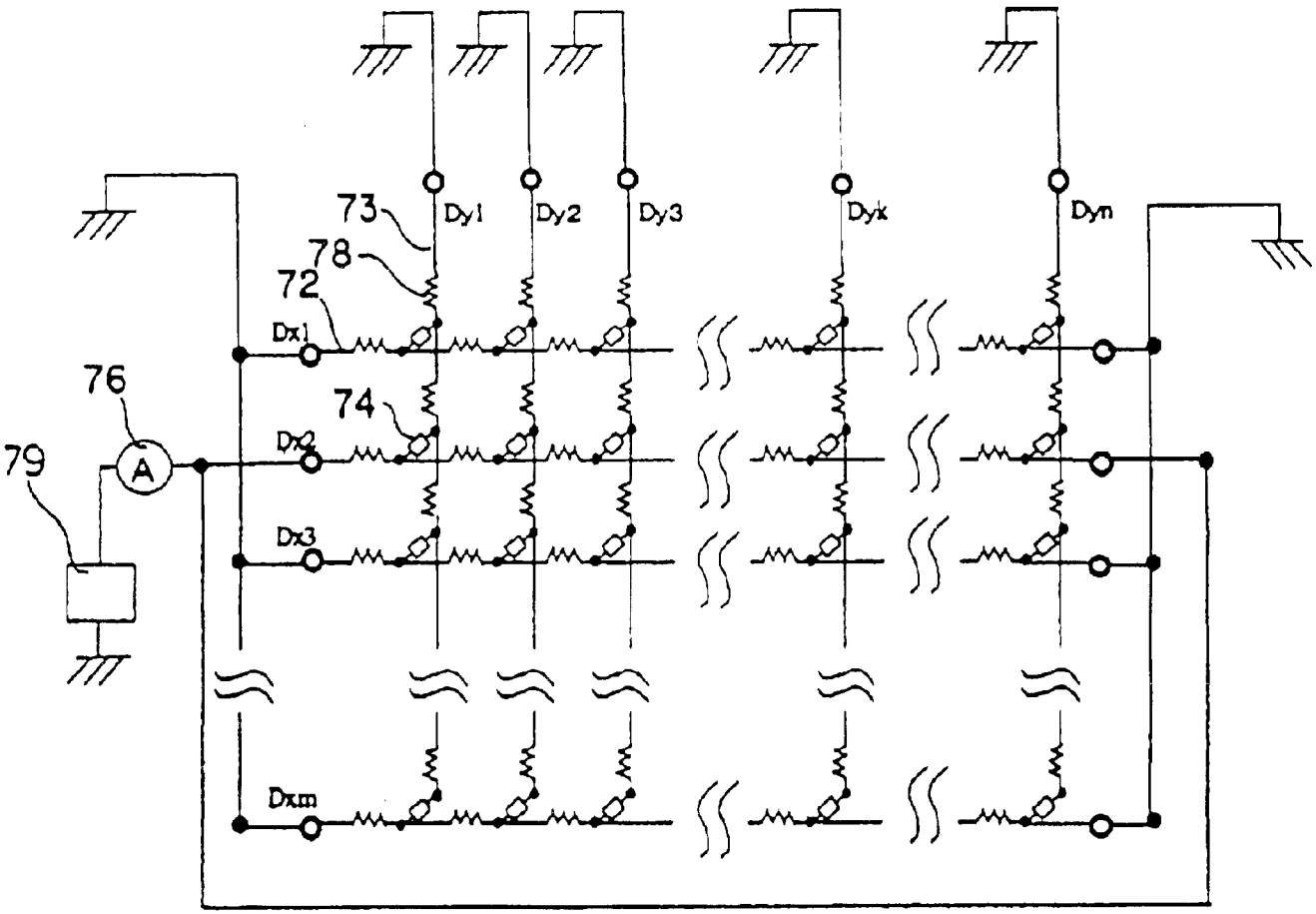
FIG. 16 shows a configuration of an apparatus for conducting energization activation in units of a row wiring.

In FIG. 18, voltages applied to respective devices in the case where energization activation is conducted for second row devices in the device configuration having the simple matrix wirings of m rows and n columns as shown in FIG. 16 are shown.

Assume that a device with a second row and a first column is F(2, 1), a device with the second row and a second column is F(2, 2), and a device with the second row and a third column is F(2, 3). In FIG. 18, the abscissa indicates a column number (pixel number). In the drawing, the influence of voltage drop on a k-th column is maximized so that only Vfk (<Vf0) is applied to a device F(2, k). Here, reference symbol Vf0 denotes a voltage in the case where no voltage drop by a wiring resistance is caused.

Figure 19:
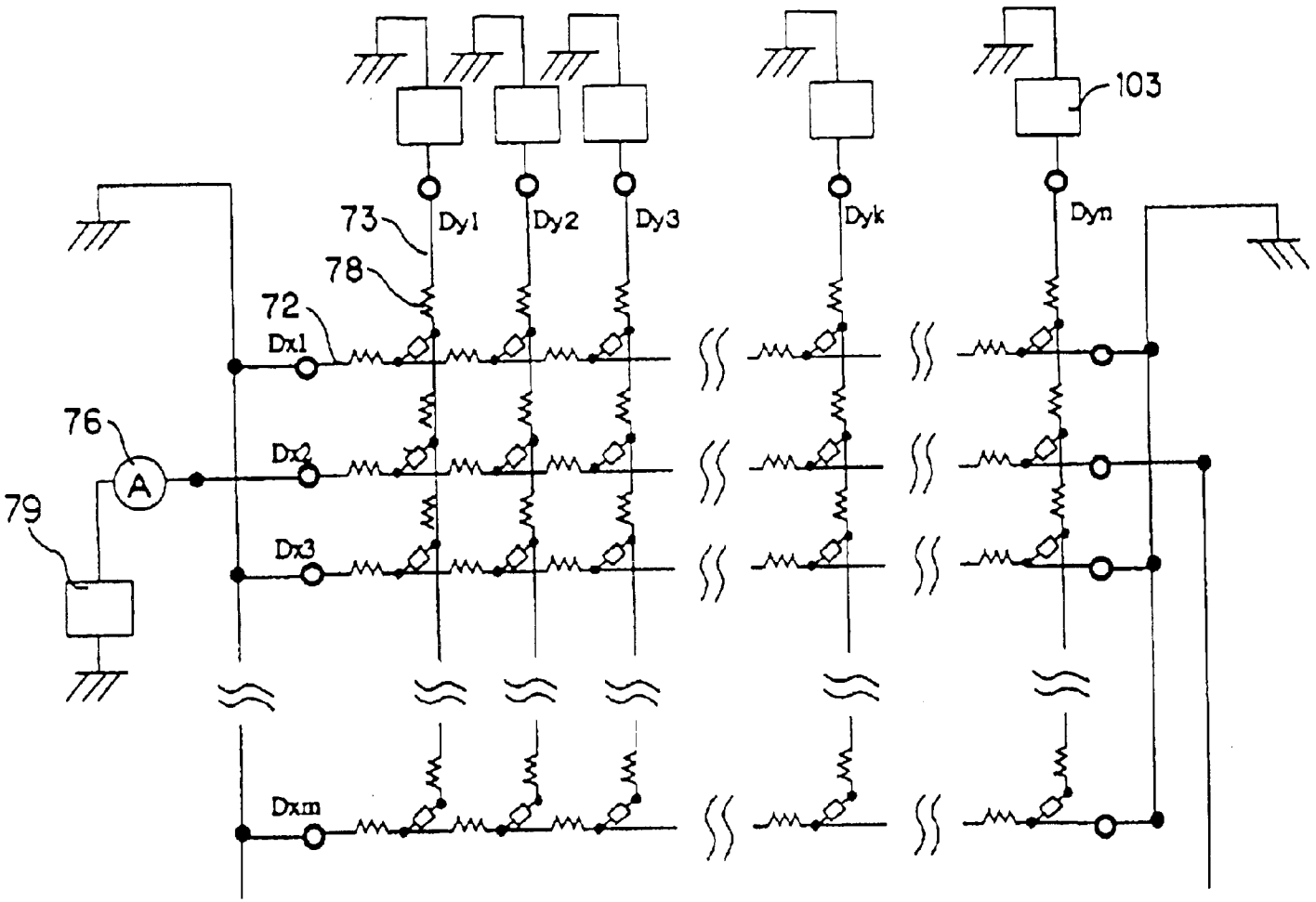
FIG. 19 shows a circuit configuration for applying a compensation voltage for compensating an influence of voltage drop.
Figure 20A:
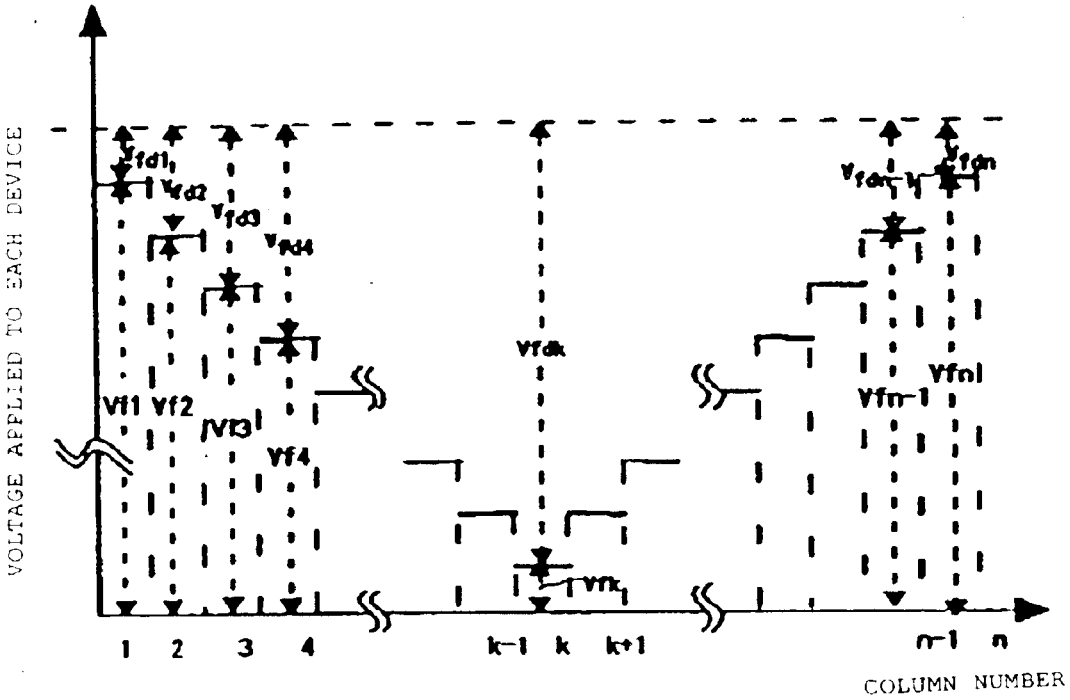
FIGS. 20A and 20B are explanatory graphs of the compensation voltage to be applied.
Figure 20B:
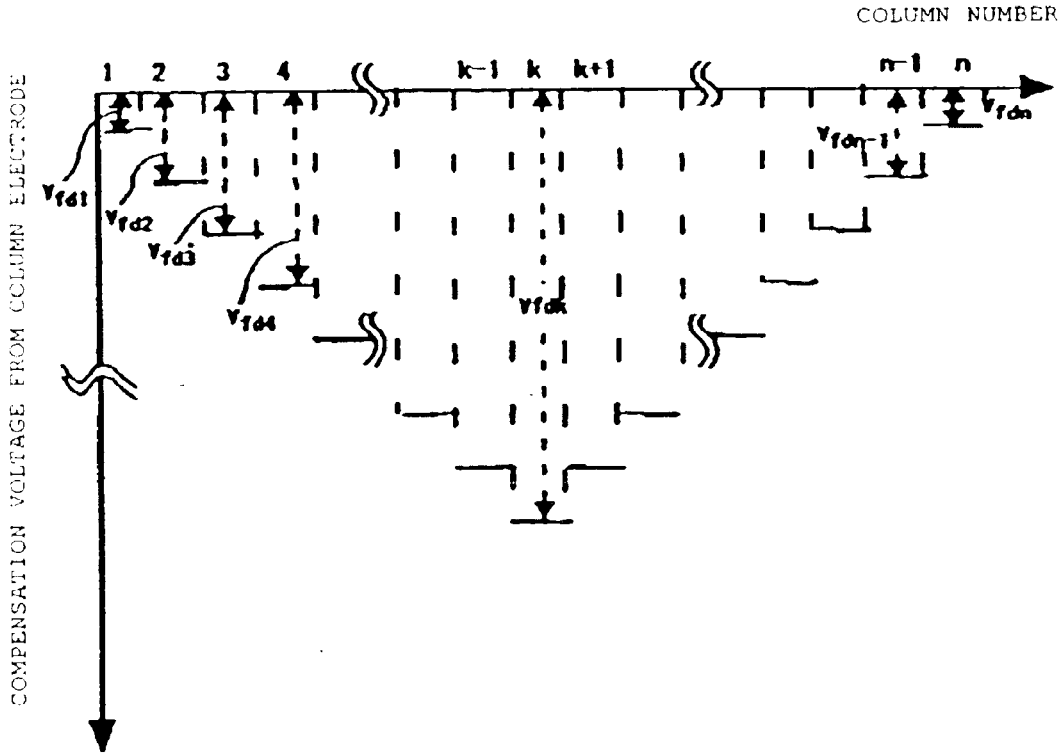

Thus, the elimination of the influence of voltage drop by the wiring resistance is solved by applying a voltage from a column side (pixel side) electrode. FIG. 19 shows a circuit for compensating the influence of voltage drop from a column side, and FIGS. 20A and 20B show voltages applied from the column side.

A device current flowing at the energization activation is measured by the ammeter 76 (FIG. 16) connected with the row wirings. Then, an amount of voltage drop by the row wiring resistance is calculated in succession from the current value If0. Thus, a voltage corresponding to the amount of voltage drop which is to be outputted from the column side can be calculated as follows.

For example, the case where the second row devices are activated will be described.

When a voltage Vf0 is applied from the second row and voltages Vfk (k=1 . . . n) corresponding to the amounts of voltage drop by the row wiring resistance are applied from the column wiring side, Vf0 is applied to all the second row devices.

The same voltage is applied to all the second row devices. Thus, even in a device current if0, it can be considered that a constant current if0=If0/n flows into all devices.

Assume that a current value measured by the ammeter 76 is If0 and a resistance 78 between the row wiring devices in the matrix portion is r0. Here, assume that the resistance between the column wiring devices is extremely small and can be neglected.

Thus, the voltages to be outputted from the column wirings are calculated as follow.

That is, when k is 1 to n/2, each of the voltages is obtained by, $$Vfk=0.5\times k\times r0\times If0-0.5\times(k-1)\times k\times r0\times if0$$

Also, when k is (n/2+1) to n, each of the voltages is obtained by, $$Vfk=0.5\times(n-k+1)\times r0\times If0-0.5\times(n-k+1)\times(n-k)\times r0\times if0$$

It is found that the voltages to be outputted to the column wirings can be uniquely determined from the current If0 measured from the row wiring.

Next, "the method of eliminating the influence of a variation in activation gas atmosphere" will be described.

Here, a variation in activation gas atmosphere and the influence of the variation in the case where energization activation is conducted for an electron source having a large number of devices will be described before the description of the method of eliminating the influence of a variation in activation gas atmosphere.

When energization activation is conducted for a large number of electron emitting devices in an electron source substrate in succession in units of row wiring, a large amounts of activation gases are consumed in a vacuum chamber for activation processing. Thus, an activation gas atmosphere is varied until the amount of activation gas introduction (supply) and the amount of activation gas consumption reach a balance state.

Therefore, a device current characteristic of an electron emitting device which is initially activated is different from that of an electron emitting device which is finally activated, thereby deteriorating the uniformity in the electron source.

Figures 21A, 21B:
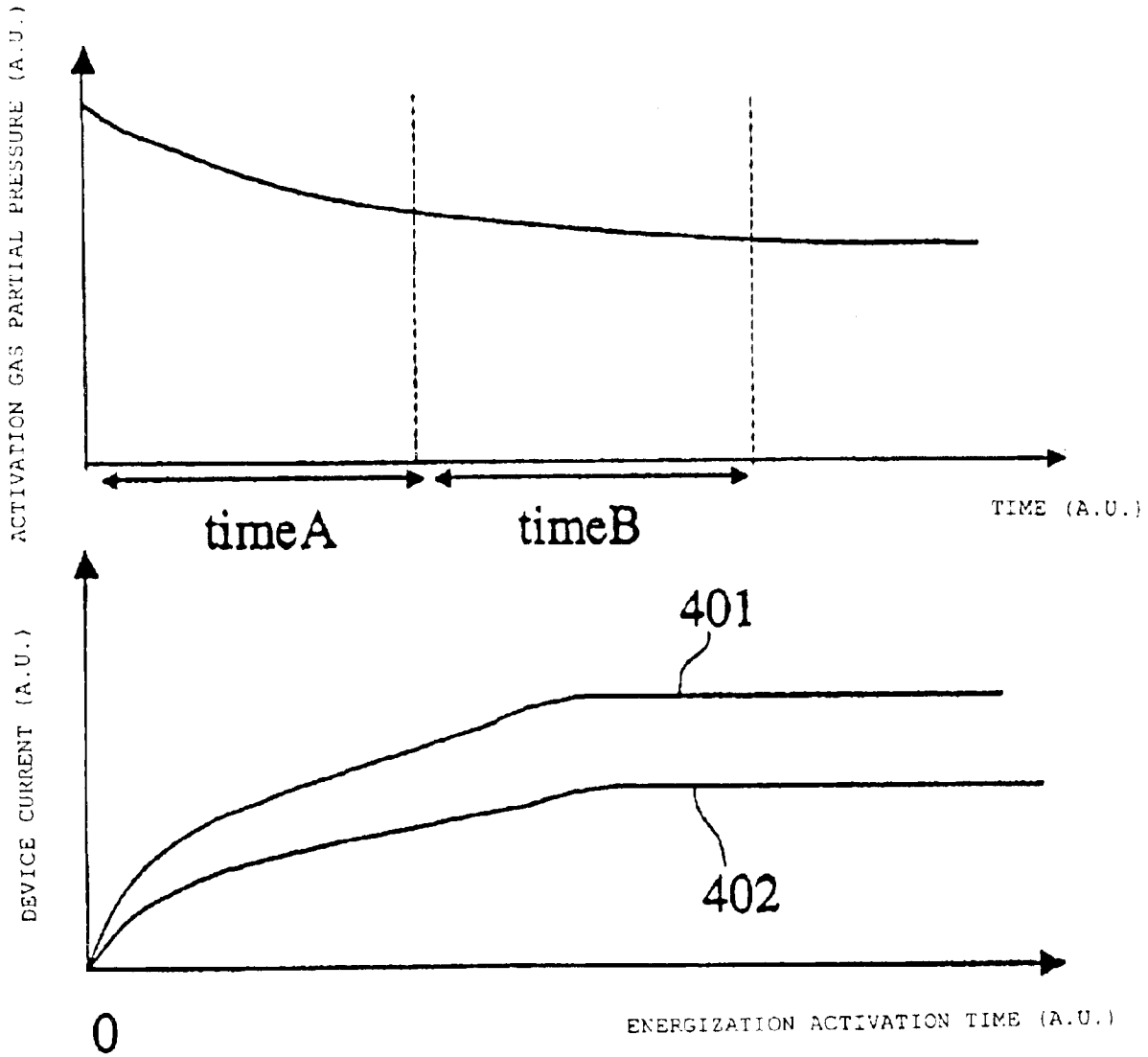
FIGS. 21A and 21B are explanatory graphs showing a variation in activation gas and a difference between device current characteristics.

FIGS. 21A and 21B show a variation in activation gas and a difference of device current characteristics. FIG. 21A shows a variation in activation gas in the vacuum chamber for activation processing at activation processing. In addition, FIG. 21B shows a profile of a device current If at energization activation.

Here, the energization activation is conducted for the second row (FIG. 16) during a period of "time A" and the energization activation is conducted for the third row (FIG. 16) during a period of "time B". When the energization activation is conducted for the second row, the partial pressure of the activation gas is high so that a device current 401 is saturated to a large value. On the other hand, even when the energization activation is conducted for the third row, a device current 402 is saturated to a small value.

As described above, when the energization activation is conducted for a large number of electron emitting devices at the same time, the activation gas atmosphere is varied to influence an electron source characteristic.

The present inventors have been concentratedly studied. As a result, it is found that, when the energization activation process is divided into a plurality of processes of at least two stages, an energization activation time can be shortened and the deterioration of the uniformity of emission current values in the electron source can be prevented.

In other words, this can be realized by using one of the following two processes or both.

(1) A process of changing a row wiring for which energization is performed at two or more stages with decreasing a concentration of an organic substance by the energization activation process (hereinafter, this process is called an energization time distributed activation process) is used.

(2) A process of varying an activation gas at two or more stages in the energization activation process (hereinafter, this process is called a multi-stage partial pressure adjustment activation process) is used.

The above two processes will be described in detail.

(1) Energization Time Distribution Activation Process

In this process, the row wiring for which energization is performed is changed according to a variation in an activation gas partial pressure. For example, the row wiring for which energization is performed is changed and driven every time several energization pulses are applied.

When such a method is used, an unevenness in emission current characteristics due to a variation in activation gas partial pressure according to the order of energization activation process can be suppressed.

For a brief description, the case where a simple matrix wiring is 2 rows and n columns and energization is alternately performed for the second row and the first row will be described as an example.

Figure 22:
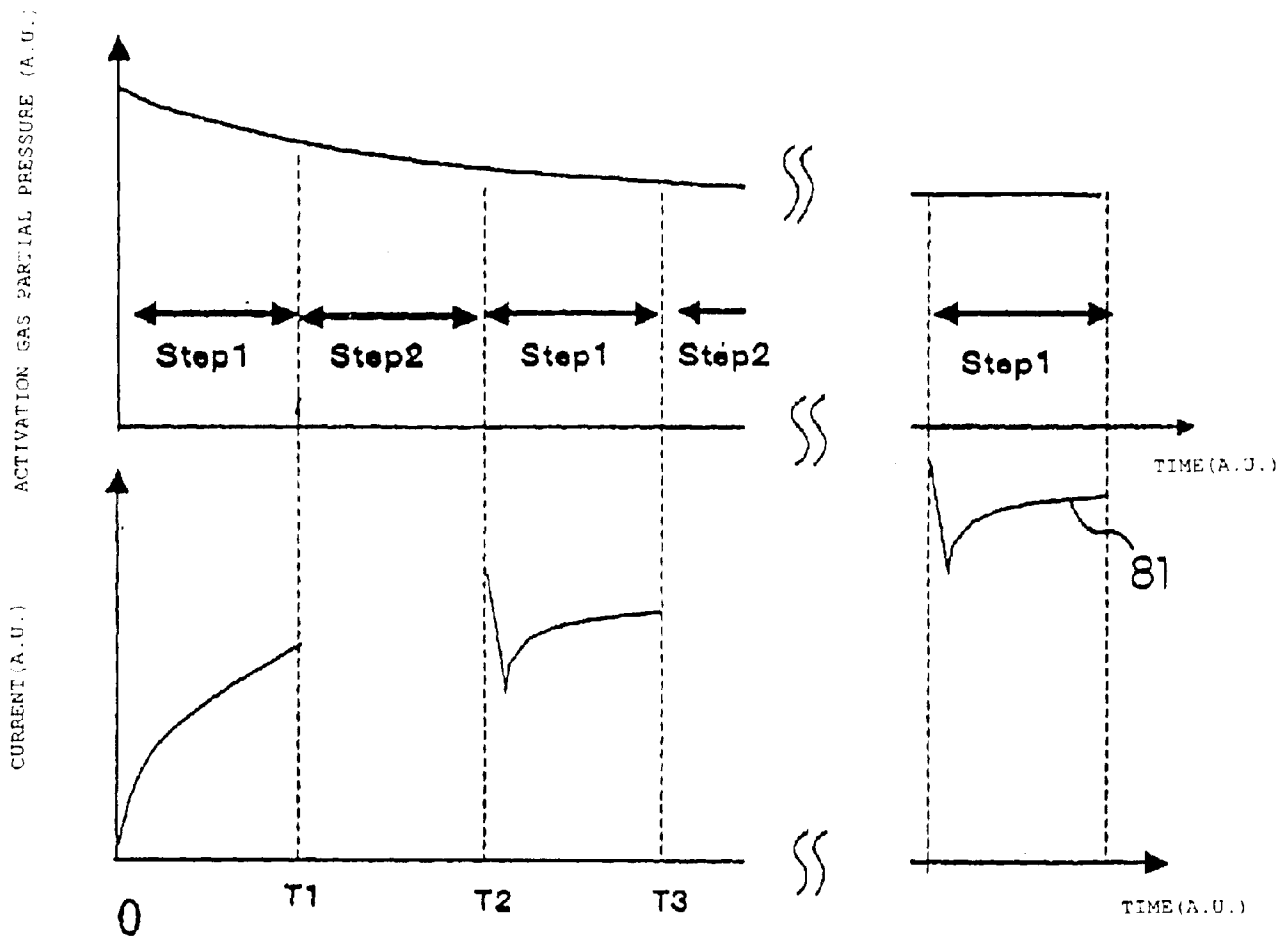
FIG. 22 shows a change in device current and a change in activation gas partial pressure in the case where a row wiring for which energization is performed is changed according to a variation in activation gas partial pressure.

FIG. 22 schematically shows a profile of a device current in the second row with respect to the passage of time and a profile of an activation gas partial pressure with respect to the passage of time.

(Step 1)

First, energization activation is conducted for the second row up to a time T1 (a.u.).

(Step 2)

At the time T1, the energization activation for the second row is stopped because an energization process is performed for the first row, and energization activation is conducted for the first row.

(Step 1, Second Time)

At a time T2 (a.u.), the energization for the first row is stopped because the energization is again performed for the second row, and the energization activation is again conducted for the second row.

Hereinafter, "STEP 1" and "STEP 2" are repeated.

When the energization is again performed for a device which is left without energization in an activation gas atmosphere, as an ideal state, a device current indicates a behavior as shown by a reference numeral 81. In other words, a current value at the instant of energization becomes larger than a final value at previous energization (previous STEP 1) and suddenly decreased, and then the rise of a device current is stably produced.

(2) Multi-Stage Partial Pressure Adjustment Activation Process

In this process, an activation gas partial pressure is actively controlled and an energization activation process is performed.

During an initial period of the activation for which large amounts of activation gases are consumed, a variation factor of the activation gas partial pressure can be reduced by increasing the activation gas partial pressure.

When such a method is used, an unevenness in emission current characteristics due to a variation in activation gas partial pressure according to the order of energization activation process can be suppressed.

In order to describe the concept of this process, the method of changing the activation gas partial pressure at two stages will be described using as an example the case where energization activation is conducted for the second row in the simple matrix wiring.

Figure 23:
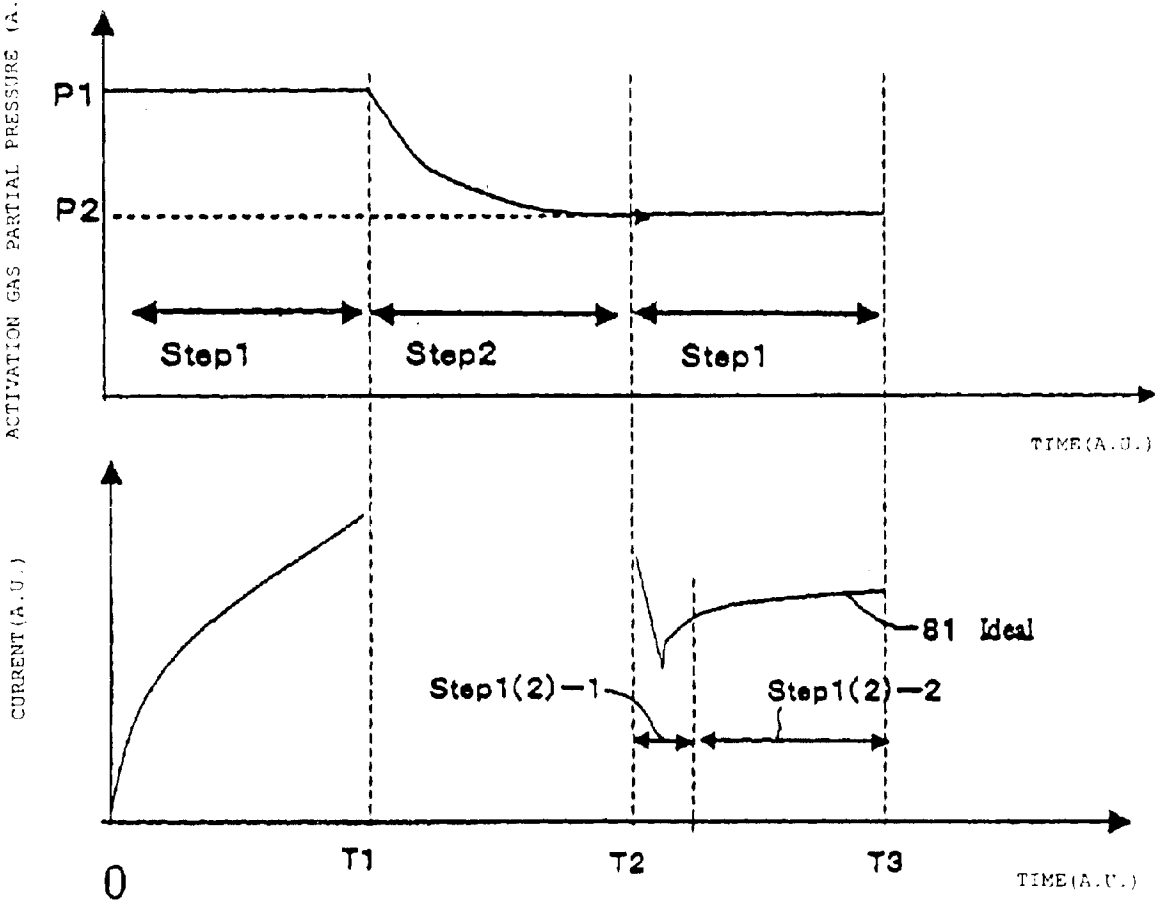
FIG. 23 shows a change in device current and a change in activation gas partial pressure in the case where an energization activation process is performed by actively controlling the activation gas partial pressure.

FIG. 23 schematically shows a profile of a device current in the second row with respect to the passage of time and a profile of an activation gas partial pressure with respect to the passage of time.

(Step 1)

First, an activation gas partial pressure is set to P1 and energization activation at the first stage is conducted up to a time T1 (a.u.).

(Step 2)

At the time T1, the energization at the first stage is stopped because the activation gas partial pressure is set to P2.

(Step 1, Second Time)

When the activation gas partial pressure becomes P2, the energization is again performed for the second row.

When the energization is again performed for a device which is left without energization in an activation gas atmosphere, as an ideal state, a device current indicates a behavior as shown by a reference numeral 81 in FIG. 23. In other words, a current value at the instant of energization becomes larger than a final value at previous energization (previous STEP 1) and suddenly decreased (Step1 (2)-1), and then the rise of a device current is stably produced (Step1 (2)-2).

Next, an insufficient point caused in the case where "the method of eliminating the influence of the wiring resistance by the matrix wiring" and "the method of eliminating the influence of a variation in activation gas atmosphere" are simultaneously used will be described.

When "the method of eliminating the influence of the wiring resistance by the matrix wiring" is used together with "the energization time distributed activation process" or "the multi-stage partial pressure adjustment activation process" which is described above, an excess voltage is applied to a device and there is the case where a device current characteristic and an emission current characteristic are deteriorated.

First, the case where it is used together with the energization time distributed activation process will be described.

For a brief description, the case where the matrix wiring is 2 rows and n columns and the energization is alternately performed for the second row and the first row will be described as an example.

Figure 24:
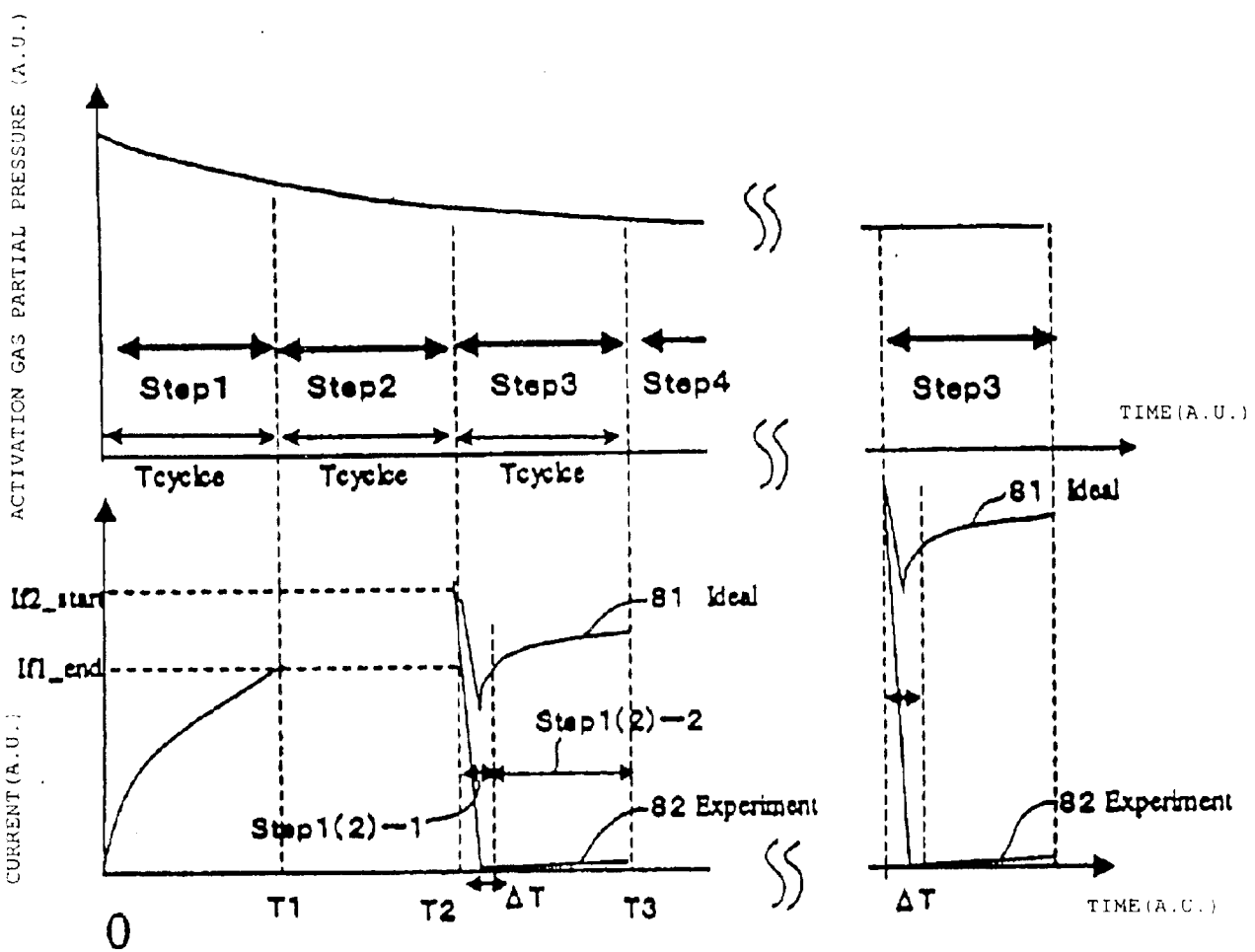
FIG. 24 shows a change in device current and a change in activation gas partial pressure in the case where both a method of eliminating an influence of a wiring resistance and an energization time distributed activation process are used.

FIG. 24 schematically shows a profile of a device current in the second row with respect to the passage of time and a profile of an activation gas partial pressure with respect to the passage of time.

(Step 1)

First, energization activation is conducted for the second row up to a time T1 (a.u.).

(Step 2)

At the time T1, the energization for the second row is stopped because an energization process is performed for the first row, and the activation is conducted for the first row.

(Step 3)

At a time T2 (a.u.), the energization for the first row is stopped because the energization is again performed for the second row, and the activation is conducted for the second row.

As described above, when the energization is again performed for a device which is left without energization in an activation gas atmosphere, as an ideal state, a device current indicates a behavior as shown by a reference numeral 81 in FIG. 24. In other words, a current value at the instant of energization becomes larger than a final value at previous energization and suddenly decreased, and then the rise of a device current is stably produced.

However, when voltage drop compensation is conducted at an initial sudden current change in STEP 3, an excess voltage is applied to a device. Thus, the emission current characteristic of the device is deteriorated or the device is broken so that there is the case where the uniformity of device characteristics is influenced thereby.

Figure 25:
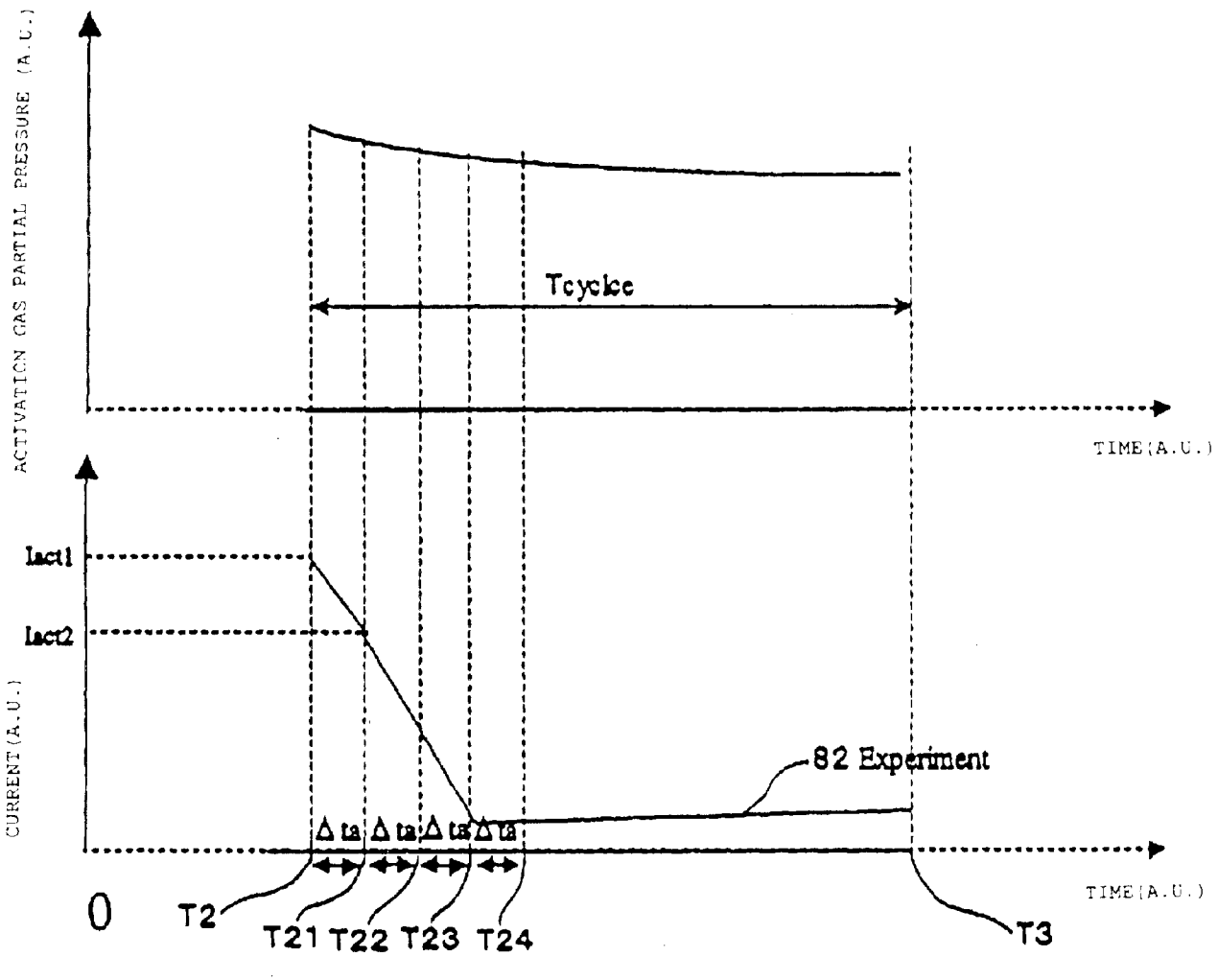
FIG. 25 is an enlarged graph showing Step 2 in FIG. 24.

This point will be described with reference to FIG. 25. This drawing is obtained by enlarging (Step2) in FIG. 24.

Here, a voltage value for compensating voltage drop by a wiring resistance is updated every Δta. As described above, an amount of voltage drop of a row wiring is calculated based on a value of a current flowing into the row wiring. Thus, it takes a time from current measurement until a compensation voltage is measured and a voltage value is set in an output power source and outputted. In this example, a period of Δta is required from the current measurement until voltage output.

When voltages applied from column wirings are calculated based on a current value Iact1 measured at T2, the following results are obtained.

(1) When K is 1 to n/2, the calculation is performed as follows:

$$Vfk(T2)=0.5\times k\times r0\times Iact1-0.5\times(k-1)\times k\times r0\times Iact1$$

(2) When K is (2+1) to n, the calculation is performed as follows:

$$Vfk(T2)=0.5\times(n-k+1)\times r0\times Iact1-0.5\times(n-k+1)\times(n-k)\times r0\times Iact1$$

The voltages corresponding to the values are to be outputted from the column wirings at the time T21 (=T2+Δta). However, a device current at this time is Iact2 (<Iact1). Thus, voltages to be outputted from the column wirings are actually as follows.

(1) When K is 1 to n/2, the following is established:

$$Vfk(T3)=0.5\times k\times r0\times Iact2-0.5\times(k-1)\times k\times r0\times Iact2<Vfk(T2)$$

(2) When K is n/2+1 to n, the following is established:

$$Vfk(T3)=0.5\times(n-k+1)\times r0\times Iact2-0.5\times(n-k+1)\times(n-k)\times r0\times Iact2<Vfk(T2)$$

Therefore, an excess voltage is applied to a device so that there is the case where a device current (emission current) is deteriorated. Thus, the emission current characteristic of the device is deteriorated or the device is broken so that this becomes a factor for adversely influencing the uniformity of device characteristics.

A device current profile in this case is indicated by a reference numeral 82.

Next, the case where it is used together with the multi-stage partial pressure adjustment activation process will be described.

For a brief description, the case where energization activation is conducted for the second row in the simple matrix wiring will be described as an example.

Figure 26:
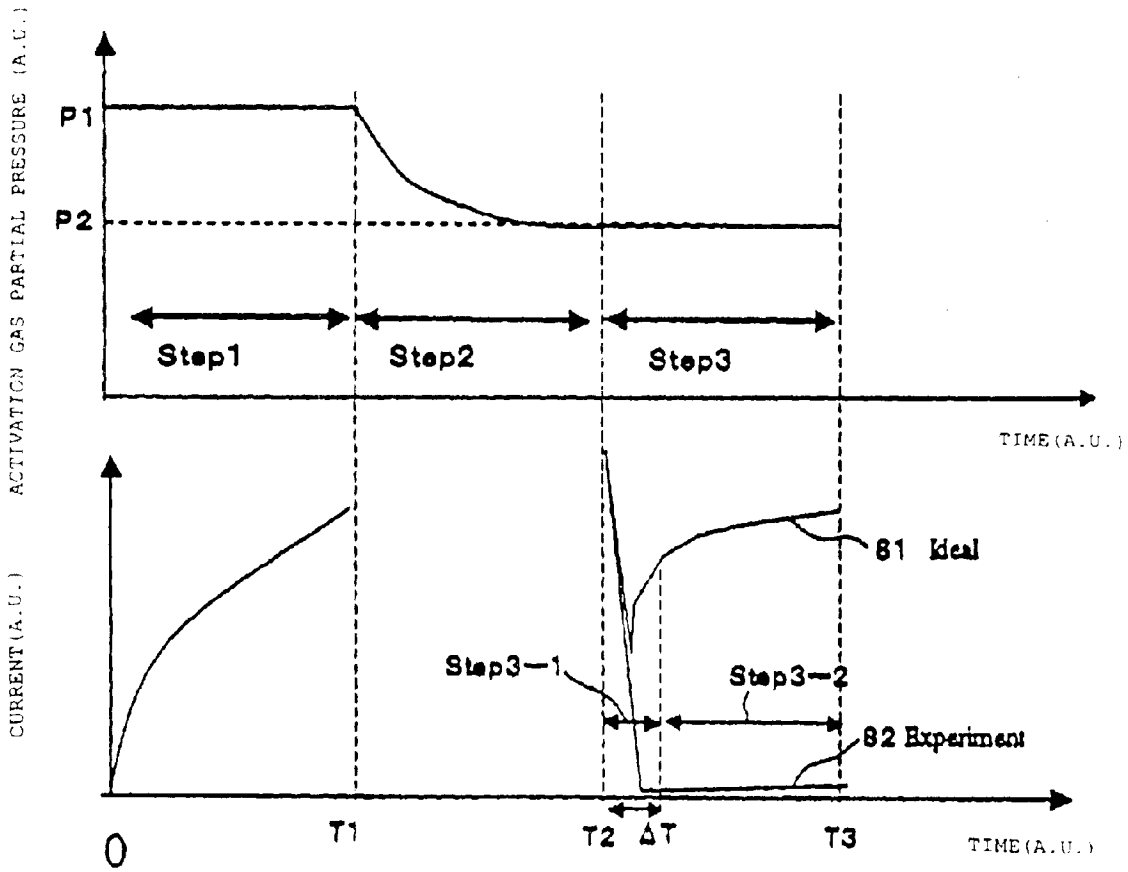
FIG. 26 shows a change in device current and a change in activation gas partial pressure in the case where both a method of eliminating an influence of a wiring resistance and a multi-stage partial pressure adjustment activation process are used.
Figure 27:
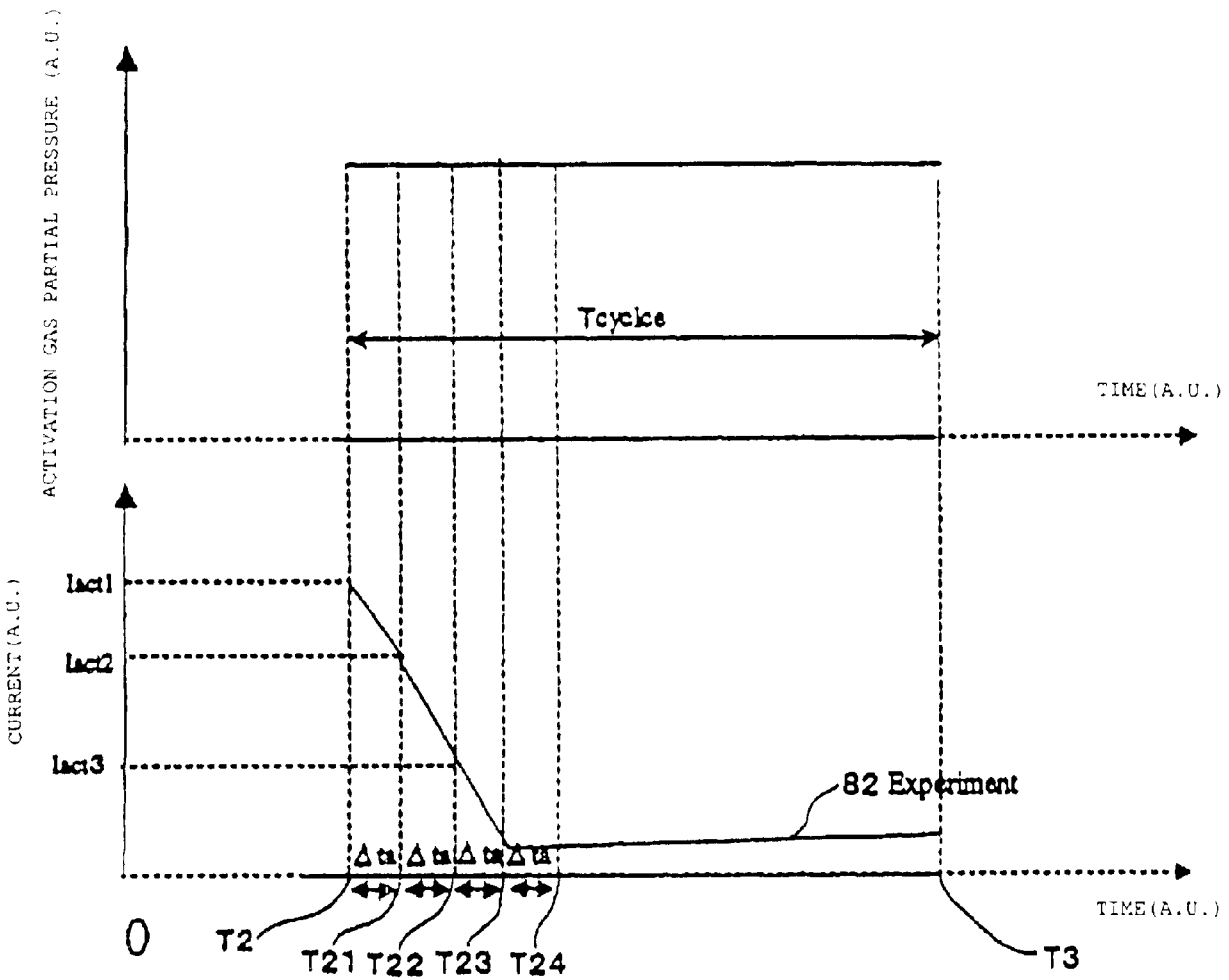
FIG. 27 is an enlarged graph showing Step 3 in FIG. 26.

FIG. 26 schematically shows a profile of a device current in the second row with respect to the passage of time and a profile of an activation gas partial pressure with respect to the passage of time. In addition, FIG. 27 is an enlarged graph of a current profile of Step 3 (experimental value 82) in FIG. 26.

(Step 1)

First, an activation gas partial pressure is set to P1 and energization activation at the first step is conducted up to a time T1 (a.u.).

(Step 2)

At the time T1, the energization at the first step is stopped because the activation gas partial pressure is set to P2.

(Step 3)

When the activation gas partial pressure becomes T2 (a.u.), the energization is again performed for the second row.

As described above, when the energization is again performed for a device which is left without energization in an activation gas atmosphere, as an ideal state, a device current indicates a behavior as shown by a reference numeral 81 in FIG. 26. In other words, a current value at the instant of energization becomes larger than a final value at previous energization and suddenly decreased, and then the rise of a device current is stably produced.

However, when voltage drop compensation is conducted at an initial sudden current change in STEP 3, an excess voltage is applied to a device. Thus, the emission current characteristic of the device is deteriorated or the device is broken so that there is the case where the uniformity of device characteristics is influenced thereby.

A process in which the excess voltage is applied is the same as in the above case where "it is used together with the energization time distributed activation process" and therefore the description is omitted here.

The present invention has been made to solve problems in such conventional techniques. An object of the present invention is to provide a method of manufacturing an electron source which is capable of uniformly performing activation processing for all electron emitting devices.

Hereinafter, preferred embodiments of the present invention will be described as examples in detail with reference with the drawings. Note that with respect to a size, a material, a shape, a relative position, and the like of each component part which are described in the embodiments, a scope of the present invention is not limited to only them in the case of no specifically specific description.

A manufacturing method and a configuration of an image display device as an application of an electron source to which the embodiment of the present invention is applied will be briefly described before a detailed description of a characteristic method of the embodiment of the present invention (method of limiting a voltage or a current for only a predetermined period in an activation process).

(Configuration and Manufacturing Method for Display Panel)

First, a configuration and a manufacturing method for a display panel of the image display device will be described using a specific example.

Figure 7:
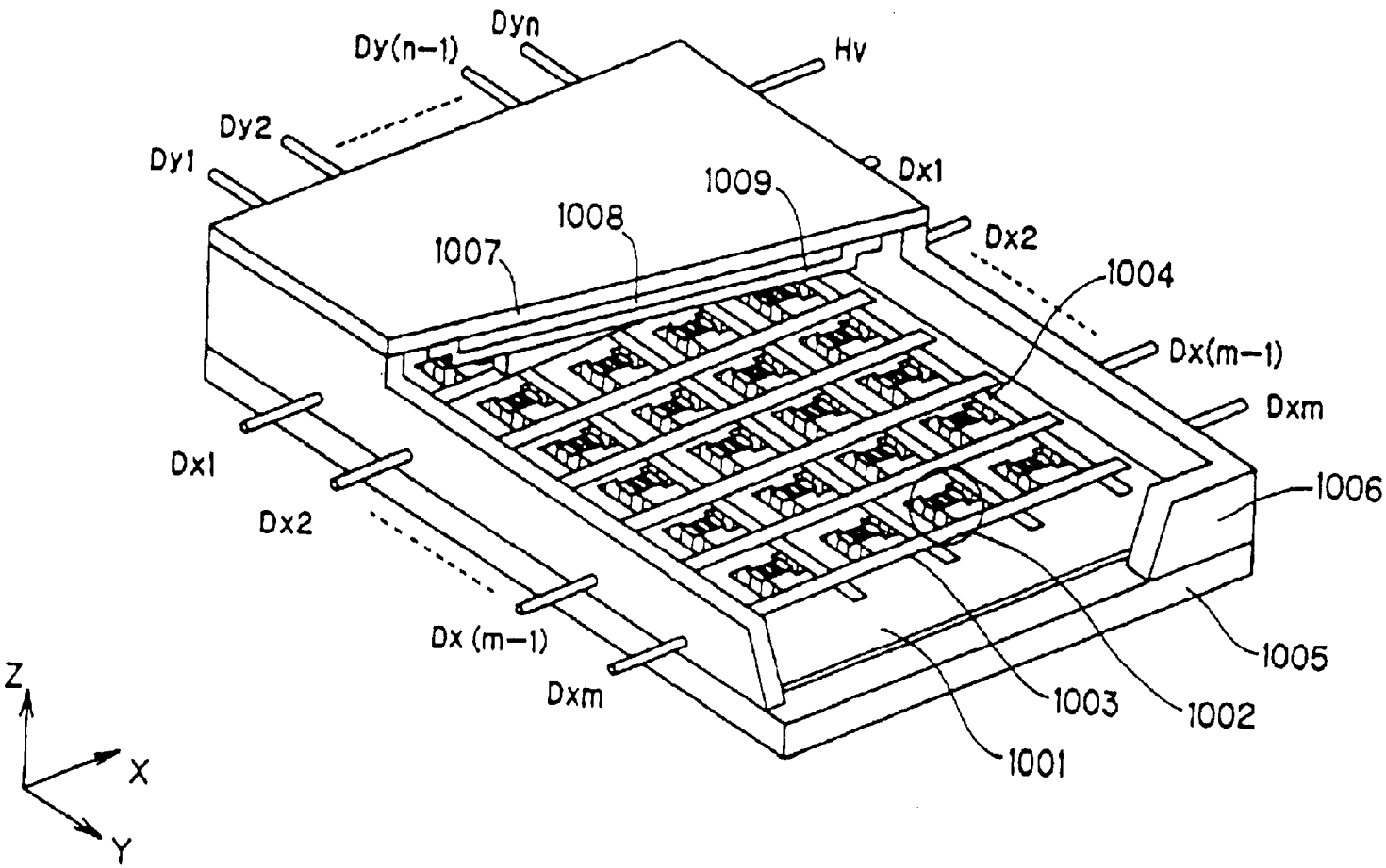
FIG. 7 is a partially cutaway perspective view of a display panel of an image display device.

FIG. 7 is a perspective view of the display panel of the image display device and shows the panel in which a portion is cut away in order to indicate an inner configuration.

In the drawing, reference numeral 1005 denotes a rear plate, 1006 denotes a side wall, and 1007 denotes face plate. An airtight enclosure for keeping an inner portion of the display panel in a vacuum is composed of them.

A fluorescent film 1008 is formed on the undersurface of the face plate 1007. The image display device of this embodiment is a color display device. Thus, phosphors of three primary colors of red, green, and blue which are used in a field of CRT are separately applied to portions of the fluorescent film 1008.

Figure 8A:
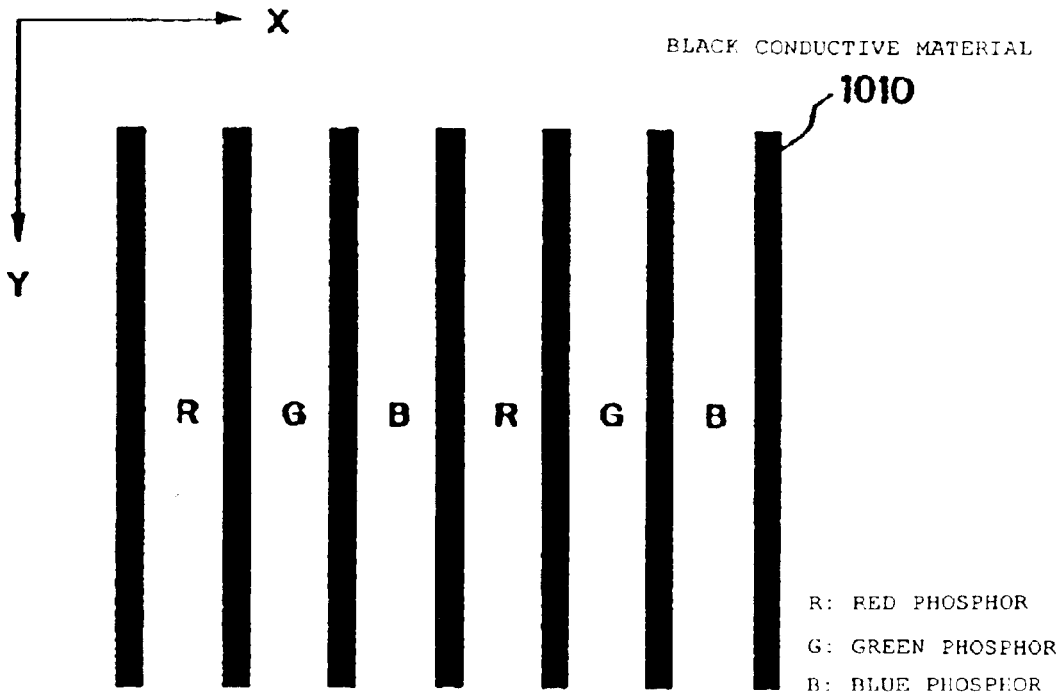
FIGS. 8A and 8B show an example of an arrangement structure of phosphors and a black conductor.
Figure 8B:
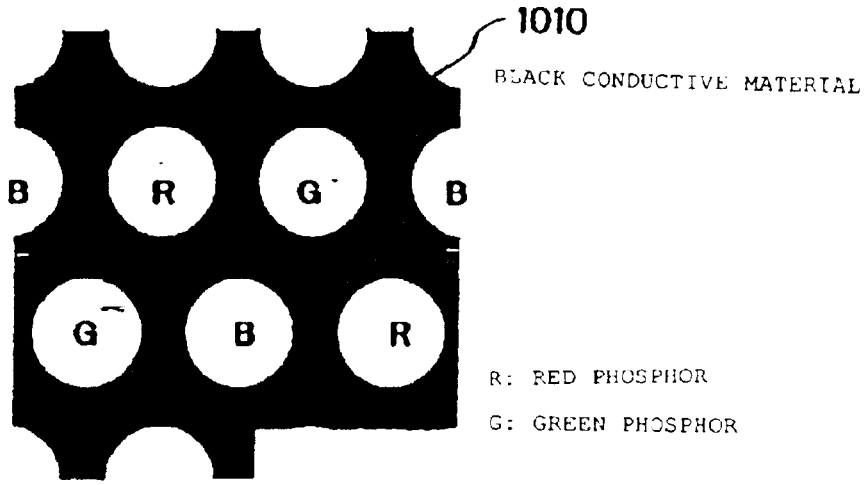

The phosphors of the respective colors are separately applied in a stripe shape, for example, as shown in FIG. 8A. A black conductor 1010 is provided between the stripes of the phosphors.

A substrate 1001 is fixed to the rear plate 1005. N×M surface conduction type electron emitting devices 1002 are formed on the substrate 1001. Here, N and M each are a positive integer equal to or larger than two and set as appropriate according to the number of pixels to be displayed on the basis of purpose. For example, in a display device having the purpose of high quality television display, it is desirable that N=3000 or more and M=1000 or more are set. In this embodiment, N=3072 and M=1024 are set.

(Typical Device Structure of Surface Conduction Type Electron Emitting Device)

As typical structures of the surface conduction type electron emitting device in which an electron emitting portion or its vicinity is made from a particle film, there are two types, a plane type and a vertical type.

(Surface Conduction Type Electron Emitting Device of Plane Type)

Figure 9A:
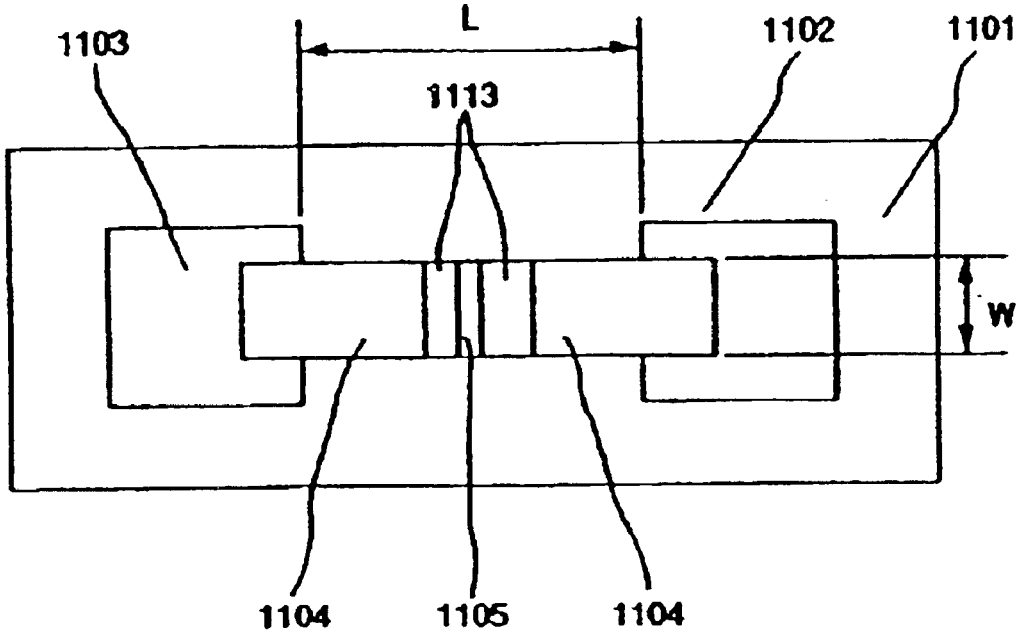
FIGS. 9A and 9B schematically show a surface conduction type electron emitting device of a plane type.
Figure 9B:
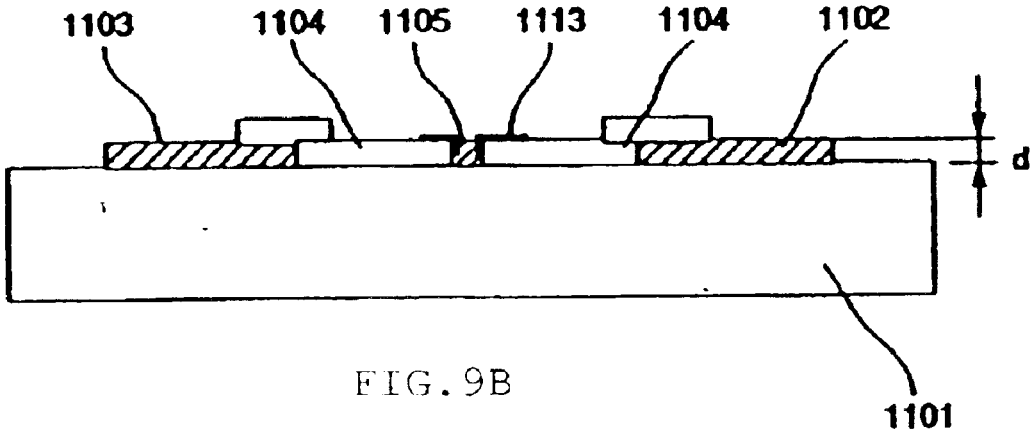

First, a device structure and a manufacturing method for a surface conduction type electron emitting device of a plane type will be described. FIGS. 9A and 9B are schematic views showing a surface conduction type electron emitting device of a plane type. FIG. 9A is a schematic plan view and FIG. 9B is a schematic cross sectional view.

In the drawings, reference numeral 1101 denotes a substrate. Reference numerals 1102 and 1103 denote device electrodes. Reference numeral 1104 denotes an electroconductive thin film. Reference numeral 1105 denotes an electron emitting portion formed by energization forming processing. Reference numeral 1113 denotes a thin film formed by energization activation processing.

As the substrate 1101, various glass substrates made of a material represented by, for example, quartz glass or soda lime glass can be used. In addition, various ceramics substrates made of a material represented by alumina can be used. Alternatively, a substrate in which an insulating layer made of, for example, $SiO_2$ is laminated on one of the above various substrates can be used.

Also, the device electrodes 1102 and 1103 are provided on the substrate 1101 in parallel with the substrate surface, opposite to each other, and made of an electroconductive material. As such a material, a material suitably selected from metal represented by Ni, Cr, Au, Mo, W, Pt, Ti, Cu, Pd, Ag or the like, alloy of these metals, metal oxide represented by $In_2O_3$-$SnO_2$, semiconductor such as polysilicon, and the like is preferably used.

When a combination of a film formation technique such as vacuum evaporation and a patterning technique such as photolithography or etching is used, these electrodes can be easily formed. The electrodes may be formed using another method (for example, a printing technique).

A shape of the device electrodes 1102 and 1103 is suitably designed according to the application purpose of the electron emitting device.

Generally, in this design, an electrode interval L is set to a suitable value selected from a range of several hundreds of angstroms ($10^{-10}$ m) to several hundreds of micrometers. In particular, when it is applied to a display device, a range of several micrometers to several tens of micrometers is preferable. In addition, a thickness d of the device electrodes is generally set to a suitable value selected from a range of several hundreds of angstroms to several micrometers.

Also, a particle film is used as the electroconductive thin film 1104. The particle film described here indicates a film containing a large number of particles as constitution elements (including island-like aggregate). When the particle film is microscopically examined, a structure in which respective particles are separately located, a structure in which particles are adjacent to one another, or a structure in which particles are overlapped with one another is generally observed.

A particle size of a particle used for the particle film is within a range of several angstroms ($10^{-10}$ m) to several thousands of angstroms. In particular, a range of 10 angstroms to 200 angstroms is preferable.

Also, a film thickness of the particle film is suitably set in consideration of various conditions described below. In other words, there are a condition required for achieving electrical and preferable connection with the device electrode 1102 or 1103, a condition required for preferably performing energization forming described later, a condition required for setting the electrical resistance of the particle film itself to a suitable value described later, and the like.

Specifically, the film thickness is set in a range of several angstroms to several thousands of angstroms, and preferably in a range of 10 angstroms to 500 angstroms.

Also, as a material used for forming the particle film, for example, there is the following material.

That is, there is metal represented by Pd, Pt, Ru, Ag, Au, Ti, In, Cu, Cr, Fe, Zn, Sn, Ta, W, Pb or the like, oxide represented by PdO, $SnO_2$, $In_2O_3$, PbO, $Sb_2O_3$, or the like, boride represented by $HfB_2$, $ZrB_2$, $LaB_6$, $CeB_6$, $YB_4$, $GdB_4$, or the like, carbide represented by TiC, ZrC, HfC, TaC, SiC, WC, or the like, nitride represented by TiN, ZrN, HfN, or the like, semiconductor represented by Si, Ge, or the like, carbon, or the like.

Thus, the material is suitably selected from them.

As described above, the electroconductive thin film 1104 is made from the particle film. In addition, the sheet resistance value is set to be within a range of $10^3$ [ohms/square] to $10^7$ [ohms/square].

Note that, it is desirable that the electroconductive thin film 1104 and the device electrodes 1102 and 1103 are electrically and preferably connected with each other. Thus, a structure is used such that these are partially overlapped with each other.

With respect to this overlap, in the example shown in FIGS. 9A and 9B, the case where the substrate 1101, the device electrodes 1102 and 1103, and the electroconductive thin film 1104 are laminated in this order from the bottom is indicated. If necessary, the substrate 1101, the electroconductive thin film 1104, and the device electrodes 1102 and 1103 may be laminated in this order from the bottom.

Also, the electron emitting portion 1105 is a crack shaped portion formed in a portion of the electroconductive thin film 1104. This has a property in which an electrical resistance is higher than the electroconductive thin film 1104 located in the vicinity.

The crack is produced by performing energization forming processing (described later) for the electroconductive thin film 1104. There is the case where a particle having a particle size of several angstroms to several hundreds of angstroms is located in the crack. Note that it is difficult to show an actual position and an actual shape of the electron emitting portion with precision and accuracy. Thus, the electron emitting portion is schematically shown in FIGS. 9A and 9B.

Also, the thin film 1113 is a carbon thin film made of carbon or carbon compound. This covers the electron emitting portion 1105 and its vicinities. The thin film 1113 is formed by performing energization activation processing (described later) after the energization forming processing.

The thin film 1113 is made of, more specifically, single crystalline graphite, polycrystalline graphite, amorphous carbon, or a mixture thereof. In addition, the film thickness is set to 500 [angstrom] or less, more preferably, 300 [angstrom] or less.

Note that it is difficult to show an actual position and an actual shape of the thin film 1113 with precision. Thus, the thin film is schematically shown in FIGS. 9A and 9B. In addition, the device in which a portion of the thin film 1113 is removed is shown in the plan view (FIG. 9A).

The fundamental structure of the preferable device is described above. In this embodiment, more specifically, the following device is used.

In other words, soda lime glass is used for the substrate 1101. An Ni thin film is used for the device electrodes 1102 and 1103. The thickness d of the device electrodes is set to 1000 [angstrom] and the electrode interval L is set to 2 [micrometer].

As a main material of the particle film, Pd or Pdo is used. A thickness of the particle film is set to about 100 [angstrom] and a width W thereof is set to 100 [micrometer].

Next, a method of manufacturing the preferable surface conduction type electron emitting device of the plane type will be described.

FIGS. 10A to 10E show steps of manufacturing the surface conduction type electron emitting device. Note that respective steps are shown by respective schematic cross sectional views of the device.

Figure 10A:
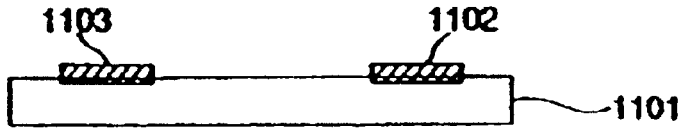
FIGS. 10A to 10E show steps of manufacturing the surface conduction type electron emitting device.

(1) First, as shown in FIG. 10A, the device electrodes 1102 and 1103 are formed on the substrate 1101.

When they are formed, the substrate 1101 is sufficiently washed in advance using detergent, pure water, and organic solvent. Then, a device electrode material is deposited on the substrate 1101. As a deposition method, a vacuum film formation technique such as an evaporation method or a sputtering method is preferably used.

After that, the deposited electrode material is patterned by using a photolithography etching technique. Thus, a pair of device electrodes (1102 and 1103) shown in FIG. 10A are formed.

Figure 10B:
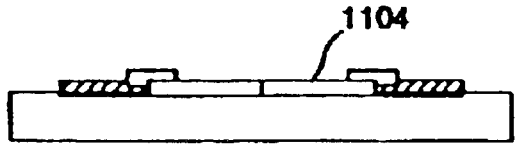

(2) Next, as shown in FIG. 10B, the electroconductive thin film 1104 is formed.

In the formation of the electroconductive thin film 1104, first, an organic metal solution is applied onto the above substrate 1101 and dried. Then, heat firing treatment is performed to form the particle film. After that, the electroconductive thin film is patterned in a predetermined form by photolithography etching.

Here, the organic metal solution is a solution of organic metal compound containing a material for the particle used for the electroconductive thin film as a main element. Specifically, in this embodiment, Pd is used as the main element. Also, in this embodiment, a dipping method is used as an applying method. Another method such as a spinner method or a spray method may be used.

As a method of forming the electroconductive thin film made from the particle film, in addition to the method by applying the organic metal solution, which is used in this embodiment, there is the case where a vacuum evaporation method, a sputtering method, a chemical vapor deposition method, or the like is used.

Figure 10C:
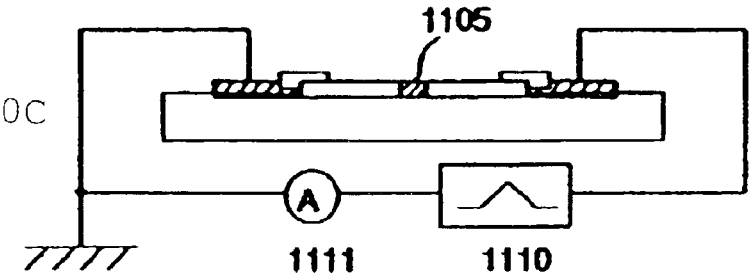

(3) Next, as shown in FIG. 10C, a suitable voltage is applied between the device electrodes 1102 and 1103 by a forming power source 1110 to perform energization forming processing. Thus, the electron emitting portion 1105 is formed.

The energization forming processing is processing for performing energization for the electroconductive thin film 1104 made from the particle film to suitably break, deform, or alter a portion thereof. By such processing, it can be changed to a structure which is preferable to conduct electron emission.

Of the electroconductive thin film made from the particle film, in a portion which is changed to the structure which is preferable to conduct electron emission (that is, in the electron emitting portion 1105), a suitable crack is produced in the thin film. Note that, an electrical resistance measured between the device electrodes 1102 and 1103 after the formation of the electron emitting portion 1105 is greatly increased in comparison with the electrical resistance before the formation of the electron emitting portion 1105.

Figure 11:
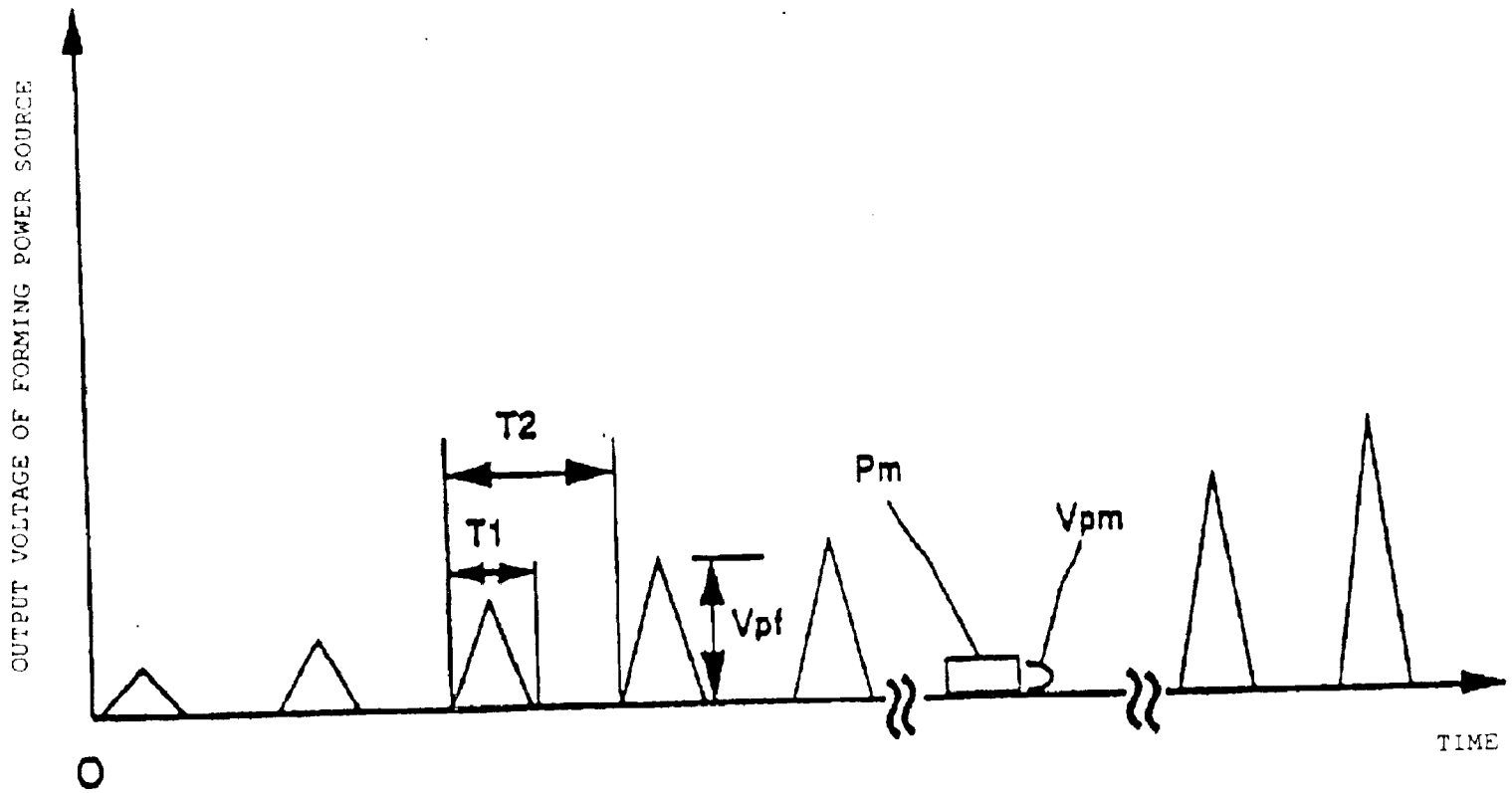
FIG. 11 shows an example of a voltage waveform at a forming process.

In order to describe an energization method in detail, an example of a waveform of a suitable voltage applied from the forming power source 1110 is shown in FIG. 11. When the forming is performed for the electroconductive thin film made from the particle film, a pulse-shaped voltage is preferable. In this embodiment, as shown in FIG. 11, a triangular wave pulse with a pulse width T1 is continuously applied at a pulse interval T2. At this time, a peak value Vpf of the triangular wave pulse is risen stepwise. In addition, a monitor pulse Pm for monitoring a formation state of the electron emitting portion 1105 is inserted between the triangular wave pulses at a suitable interval, and a current flowing at this time is measured by an ammeter 1111.

According to this embodiment, in the case of a vacuum atmosphere with about $1.3\times10^{-3}$ [Pa], for example, the pulse width T is set to 1 [millisecond] and the pulse interval T2 is set to 10 [millisecond]. In addition, the peak value Vpf is risen by 0.1 [V] for every one pulse.

Then, one monitor pulse Pm is inserted each time five triangular wave pulses are applied. In order not to affect forming processing, a voltage Vpm of the monitor pulse is set to 0.1 [V]. When the electrical resistance between the device electrodes 1102 and 1103 becomes $1\times10^{-6}$ [ohm], that is, when a current measured by the ammeter 1111 at the application of the monitor pulse becomes $1\times10^{-7}$ [A] or less, energization related to the forming processing is completed.

Note that the above method is a preferable method with respect to the surface conduction type electron emitting device according to this embodiment. For example, when the design of the surface conduction type electron emitting device, such as a material and a film thickness of the particle film or the device electrode interval L is changed, it is desirable that an energization condition is suitably changed according to the changed design.

Figure 10D:
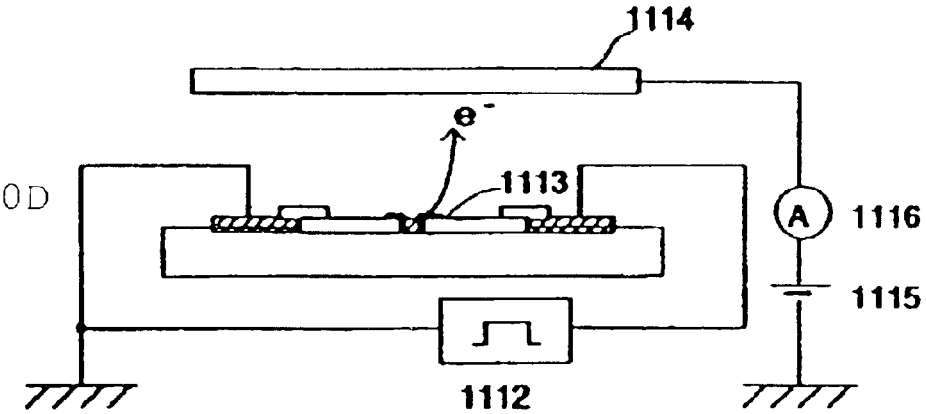

(4) Next, as shown in FIG. 10D, a suitable voltage is applied between the device electrodes 1102 and 1103 by an activation power source 1112 to perform energization activation processing. Thus, an electron emitting characteristic is improved.

"The energization time distributed activation process", "the multi-stage partial pressure adjustment activation process", and "the compensation voltage activation process" in the energization activation processing of the electron source, which are the features of the embodiment of the present invention will be described later in detail. Here, a summary of the energization activation processing will be described.

The energization activation processing is specifically processing for periodically applying a voltage pulse in an activation gas atmosphere. Thus, this is processing for depositing carbon or carbon compound of organic compound origin to improve the electron emitting characteristic.

Appropriate organic materials to be used herein include: aliphatic hydrocarbon such as alkane, alkene, and alkyne; aromatic hydrocarbon; alcohols; aldehydes; ketones; amines; and organic acids such as phenol; carvone; or sulfonic acid. More specifically, the organic material may be: saturated hydrocarbon represented by $CnH_{2n+2}$ such as methane, ethane and propane; unsaturated hydrocarbon represented by the composition formula of $CnH_{2n}$ or the like such as ethylene and propylene; benzene; toluene; benzonitrile; methanol; ethanol; formaldehyde; acetaldehyde; acetone; methylethyl ketone; methylamine; ethylamine; phenol; formic acid; acetic acid; propionic acid; and the like.

Figure 12A:
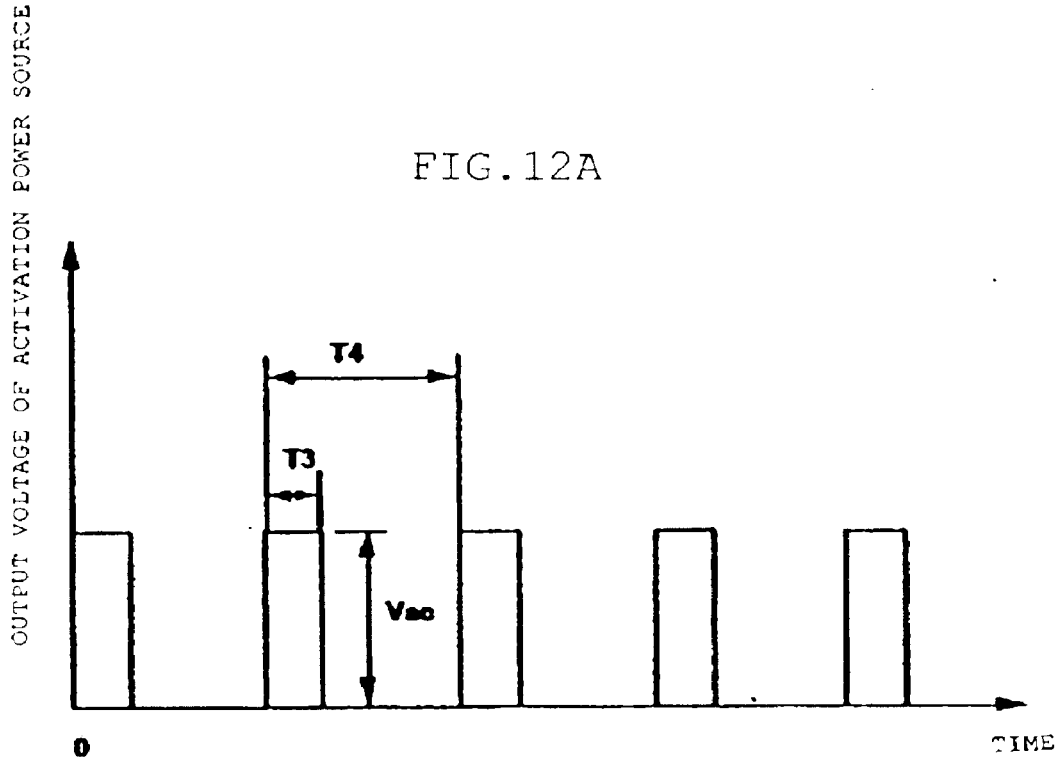
FIG. 12A shows an example of a voltage waveform at a forming process and FIG. 12B shows an amount of emission current during an activation process.

In order to describe an energization method in detail, an example of a waveform of a suitable voltage applied from the activation power source 1112 is shown in FIG. 12A. In this embodiment, a rectangular wave with a constant voltage is periodically applied to perform the energization activation processing. Specifically, the processing is performed using a rectangular wave in which a voltage Vact is 14 [V], a pulse width T3 is 1 [millisecond], and a pulse interval T4 is 10 [millisecond].

Note that the above energization condition is a preferable condition with respect to the surface conduction type electron emitting device according to this embodiment. When the design of the surface conduction type electron emitting device is changed, it is desirable that the condition is suitably changed according to the changed design.

Reference numeral 1114 shown in FIG. 10D denotes an anode electrode for trapping an emission current Ie emitted from the surface conduction type electron emitting device. The anode electrode 1114 is connected with a direct current high voltage power source 1115 and an ammeter 1116. Note that, when activation processing is performed after the substrate 1101 is incorporated into a display panel, a fluorescent surface of the display panel is used as the anode electrode 1114.

Figure 12B:
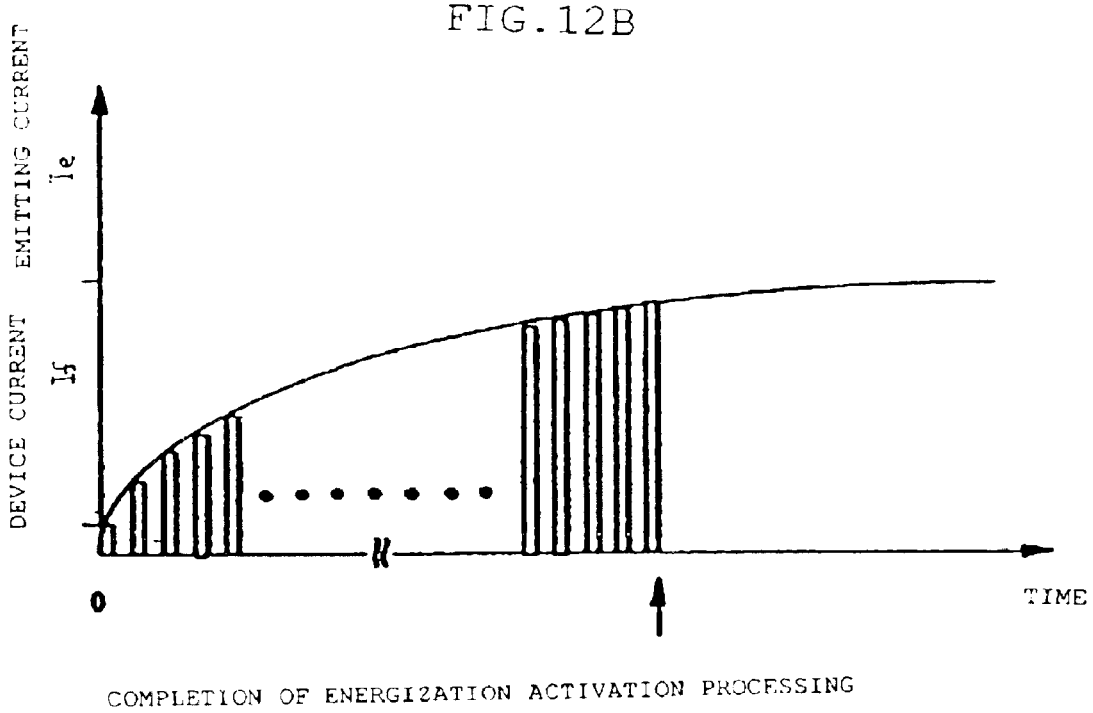

While the voltage is applied from the activation power source 1112, the emission current Ie is measured by the ammeter 1116 to monitor a progress state of the energization activation processing. Thus, the operation of the activation power source 1112 is controlled. An example of the emission current Ie measured by the ammeter 1116 is shown in FIG. 12B. As shown in the drawing, when the application of a pulse voltage from the activation power source 1112 is started, the device current If and the emission current Ie are increased with the elapse of time. When the emission current Ie reaches a predetermined current value, the application of the voltage from the activation power source 1112 is stopped to complete the energization activation processing.

Figure 10E:
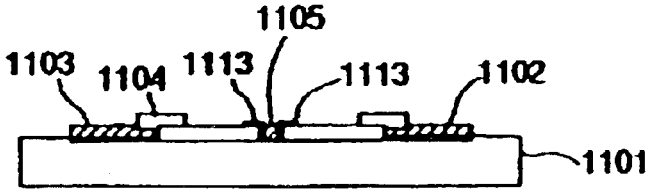

By the above steps, the surface conduction type electron emitting device of the plane type as shown in FIG. 10E is manufactured.

(Characteristic of Surface Conduction Type Electron Emitting Device Used for Display Device)

The device structure and the manufacturing method with respect to the surface conduction type electron emitting device of the plane type are described above. Next, a characteristic of the device used for the display device will be described.

Figure 13:
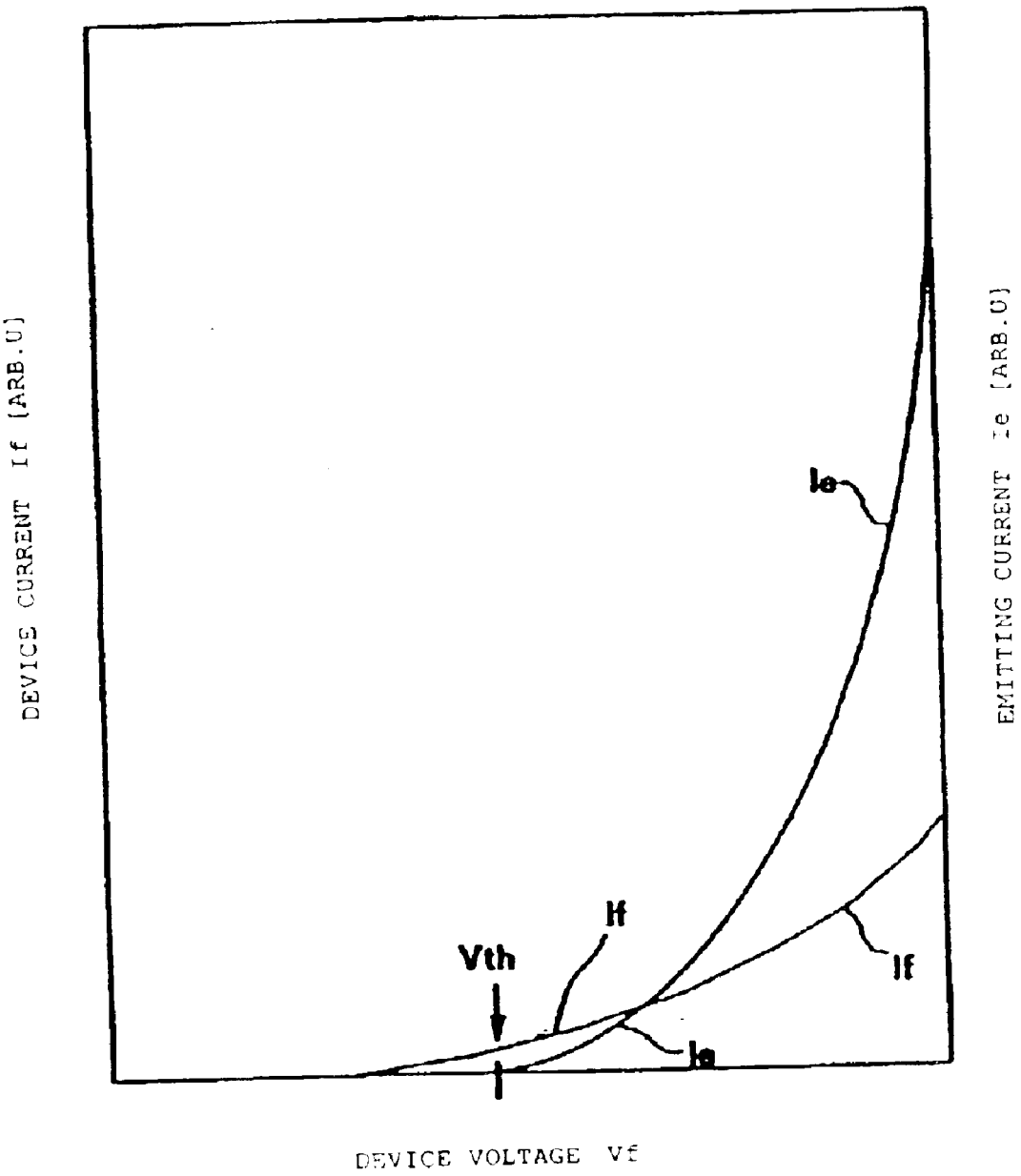
FIG. 13 is a current characteristic graph of an electron emitting device.

FIG. 13 shows a typical example of characteristics (characteristic between the emission current Ie and a device application voltage Vf and characteristic between the device current If and the device application voltage Vf) in the device used for the display device.

Note that the emission current Ie is extremely smaller than the device current If, it is difficult to show these current values with the same scale. In addition, these characteristics are changed according to design parameters such as a device size, a device shape, or the like. Thus, two graphs are shown with respective arbitrary units.

The device used for the display device has three properties described below with respect to the emission current Ie.

First, when a voltage (this is called a threshold voltage Vth) or higher is applied to the device, the emission current Ie is suddenly increased. On the other hand, when a voltage lower than the threshold voltage Vth is applied to the device, the emission current Ie is not almost detected.

In other words, with respect to the emission current Ie, this is a non-linear device having the specific threshold voltage Vth.

Second, the emission current Ie is changed depending on the voltage Vf applied to the device. Thus, an amount of the emission current Ie can be controlled by the voltage Vf.

Third, a response of the current Ie emitted from the device according to the voltage Vf applied to the device is quick. Thus, a charge amount of electron emitted from the device can be controlled according to a period for applying the voltage Vf.

There are the above properties. Thus, the surface conduction type electron emitting device can be preferably used for the display device.

For example, in a display device in which a large number of devices are provided corresponding to pixels of a display screen, when the first property is utilized, the display screen can be sequentially scanned to perform the display. That is, a voltage equal to or higher than the threshold voltage Vth is suitably applied to the device which is driving according to desired light emitting brightness. On the other hand, a voltage lower than the threshold voltage Vth is applied to the device which is in a non-selection state. In addition, when the device to be driven is sequentially switched, the display screen can be sequentially scanned to perform the display.

Also, when the second property or the third property is utilized, light emitting brightness can be controlled. Thus, gray scale display can be conducted.

(Structure of Electron Source Substrate in which a Large Number of Devices are Simply Wired)

Next, a structure of an electron source substrate in which the above surface conduction type electron emitting devices are arranged on a substrate and simply wired will be described.

Figure 14:
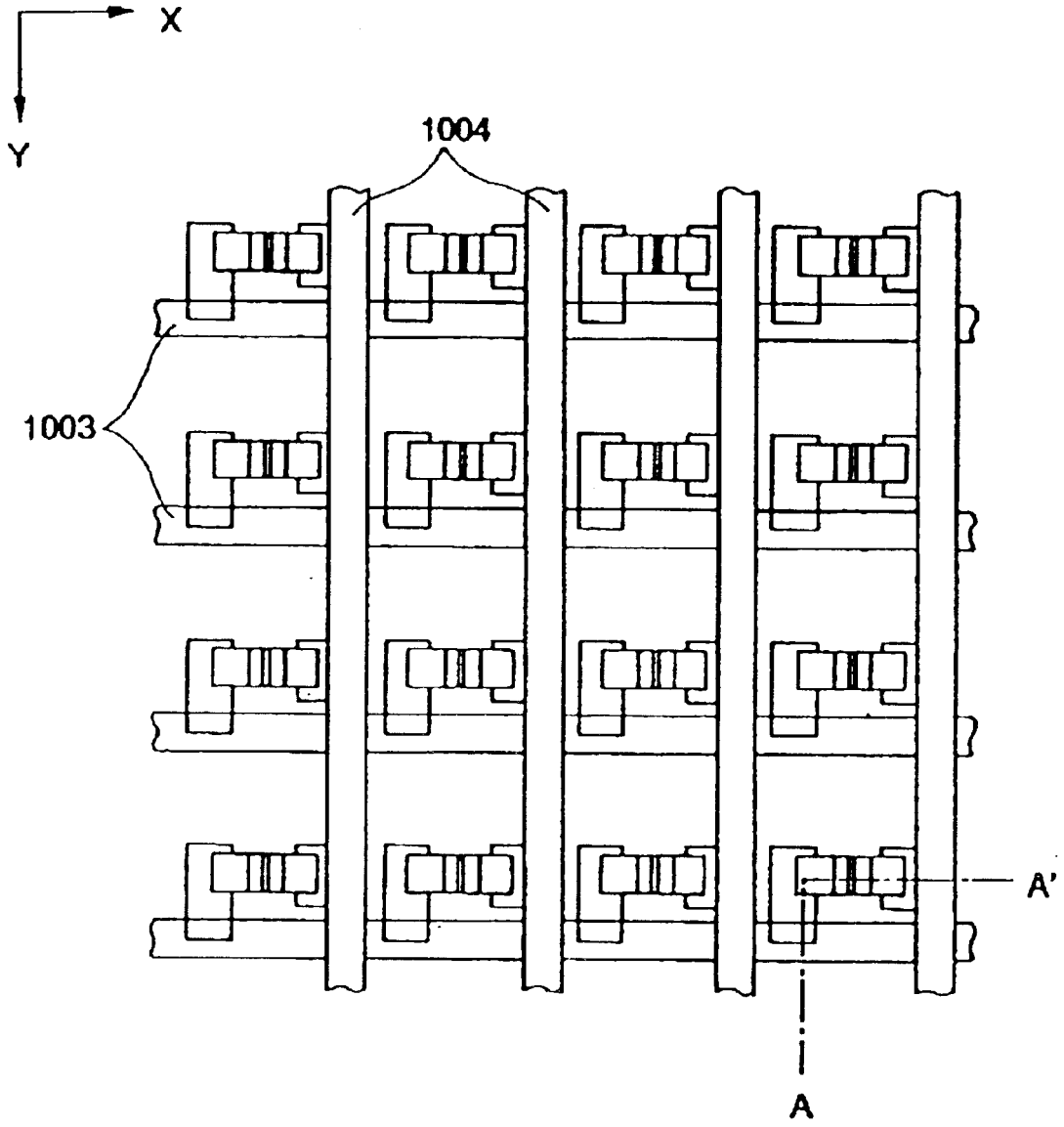
FIG. 14 is a plan view of an electron source substrate used for a display panel.

FIG. 14 is a plan view of the electron source substrate used for the above display panel shown in FIG. 7.

The surface conduction type electron emitting devices having the same structure as shown in FIGS. 9A and 9B are arranged on the substrate. These devices are wired in simple matrix form by using the row directional wirings 1003 and the column directional wirings 1004.

In intersection portions of the row directional wirings 1003 and the column directional wirings 1004, an insulating layer (not shown) is formed between the electrodes to keep electrical insulation.

Figure 15:
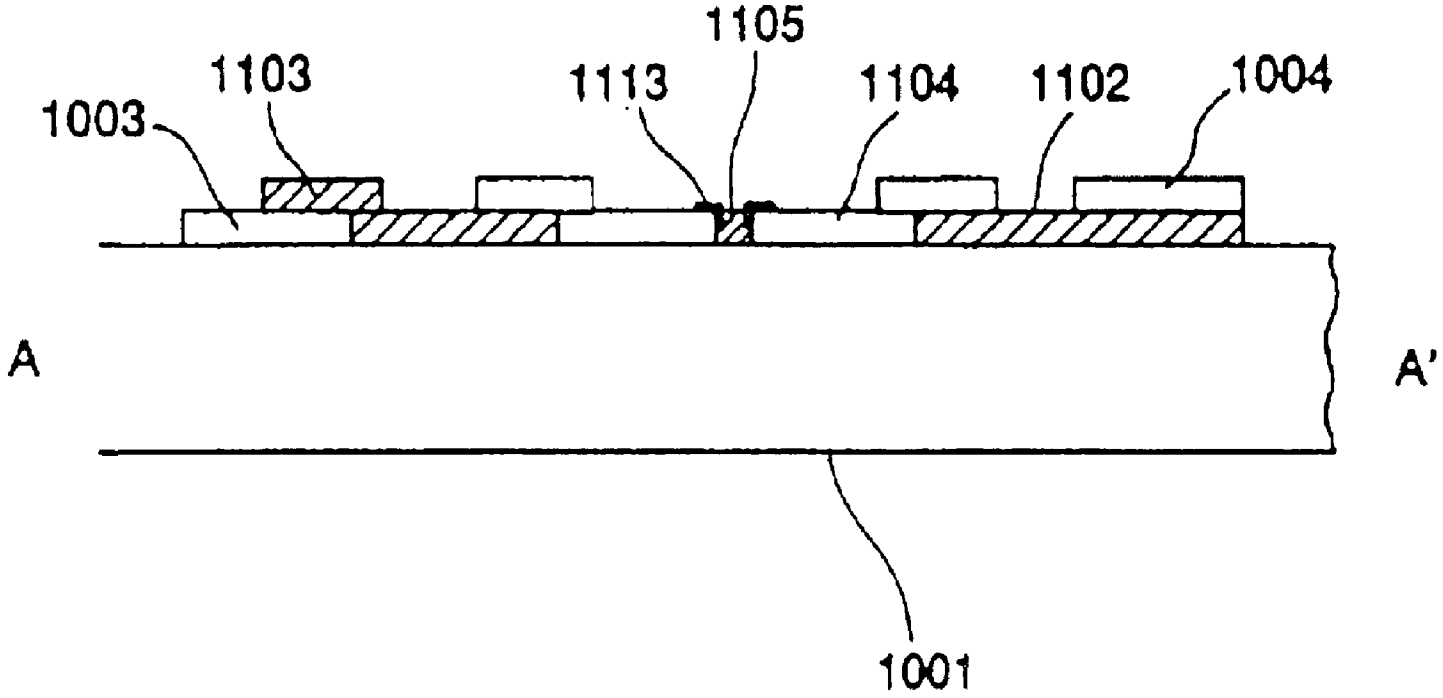
FIG. 15 is a cross sectional view along a line A–A' in FIG. 14.

A cross section along a dashed line A–A' in FIG. 14 is shown in FIG. 15.

Note that the electron source having such a structure is manufactured as follows. First, the row directional wirings 1003, the column directional wirings 1004, the insulating layer (not shown) located between the electrodes, the device electrodes of the surface conduction type electron emitting devices, and the electroconductive thin film are formed in advance on the substrate. After that, electricity is fed to the respective devices through the row directional wirings 1003 and the column directional wirings 1004 to perform energization forming processing and energization activation processing. Thus, the electron source is manufactured.

(Activation Process in Units of Row (Column) in Electron Source Substrate in which a Large Number of Devices are Wired in Simple Matrix)

Next, a method of performing activation processing for the above electron source substrate formed through the simple wiring in units of row (column) will be described. When this method is used, a large number of devices are simultaneously activated. Thus, an activation processing time can be shortened.

FIG. 16 shows a voltage applying method in the case where activation processing is performed for the second row (Dx2) devices of the surface conduction type electron emitting devices wired as in the above electron source substrate shown in FIG. 14.

As shown in FIG. 16, the surface conduction type electron emitting device 74 is connected with the row wiring 72 and the column wiring 73. In the drawing, reference numeral 77 denotes an activation power source. In addition, reference numeral 76 denotes an ammeter for measuring a device current. In order to apply a voltage to all devices of only the second row, the row wirings 72 except for the second row (Dx2) and all the column wirings 73 are grounded. By such a device connection, the voltage is applied to the row directional devices so that the activation process can be performed.

Device current measurement for observing a progress state of the activation process is conducted by the ammeter 76. With respect to an activation completion condition, when the total value of the device currents is saturated, the activation is completed.

Here, the case where the activation processing is performed for the second row (Dx2) devices is described. Even in the case where the activation processing is performed for other row devices, it can be performed using the same method.

Also, the activation process in units of row wiring is described here. When the same method is used, an activation process in units of column wiring can be performed.

Further, the method of observing the progress state of the activation process is not limited to the device current measurement and may be conducted by using emission current measurement.

The configuration, the manufacturing method, and the operation of the image display device to which this embodiment can be applied are described above.

Next, the characteristic content of this embodiment will be described.

First Embodiment

In the embodiment of the present invention, a method of conducting energization activation for a large number of devices for a short time is used in the case where "the multi-stage partial pressure adjustment activation process" and "the compensation voltage applying process" are simultaneously performed. In addition, this embodiment is characterized in that a compensation voltage at the start of energization is not outputted for a predetermined period. When this method is used, as compared with a conventional activation method, uniform activation processing can be performed and an electron source having a uniform emission current characteristic can be obtained.

In this embodiment, a manufacturing method for an image display device having an electron source substrate in which a large number of surface conduction type electron emitting devices are arranged in simple matrix (1024×3072 in the number of devices), more specifically, an example of an activation process of an electron source will be described.

Also, as the method of activating a large number of devices, a row unit activation process in which an activation process is performed row by row is conducted.

Hereinafter, only an energization activation process for the second row will be described. The same process is performed for other rows.

First, a configuration of an activation processing control apparatus used for an electron source manufacturing method according to the embodiment of the present invention is shown in FIG. 1.

FIG. 1 shows an example of an energization activation apparatus for surface conduction type electron emitting devices in this embodiment. The electron source substrate shown in FIG. 7 is connected with this apparatus as shown in FIG. 1 and an activation process is performed.

In FIG. 1, reference numeral 101 denotes an electron source substrate for multi surface conduction type electron emitting devices which is connected for energization activation. In the electron source substrate 101, a plurality of electron emitting devices are connected while wired in simple matrix of m rows and n columns (m=1024 and n=3072 in this embodiment). In addition, forming is supposedly already completed. The electron source substrate is connected with a vacuum exhaust apparatus (not shown) and is evacuated to about $1\times10^{-3}$ [Pa] to $1\times10^{-2}$ [Pa].

Reference numeral 102 denotes a row selection circuit for selecting a row to be activated. The row selection circuit 102 selects a row directional wiring in accordance with an instruction from a control circuit (control unit) 104. Thus, a voltage is applied from a power source 103 to the selected row directional wiring. In addition, the row selection circuit 102 has an ammeter 313 (see FIG. 2). A current flowing into the row directional wiring of the electron source is detected by the ammeter 313.

The control circuit 104 takes a value of a current detected by a current detecting unit of the row selection circuit and sets voltage values required for energization activation to the power source 103 and a power source 113. Reference symbols Dx1 to Dxn denote row directional wiring terminals of the electron source substrate 101 and Dy1 to Dyn denote column directional wiring terminals of the electron source substrate 101. Note that the control unit 104 has a timer and adjusts an energization activation time and a time at which a partial pressure is changed.

Figure 2:
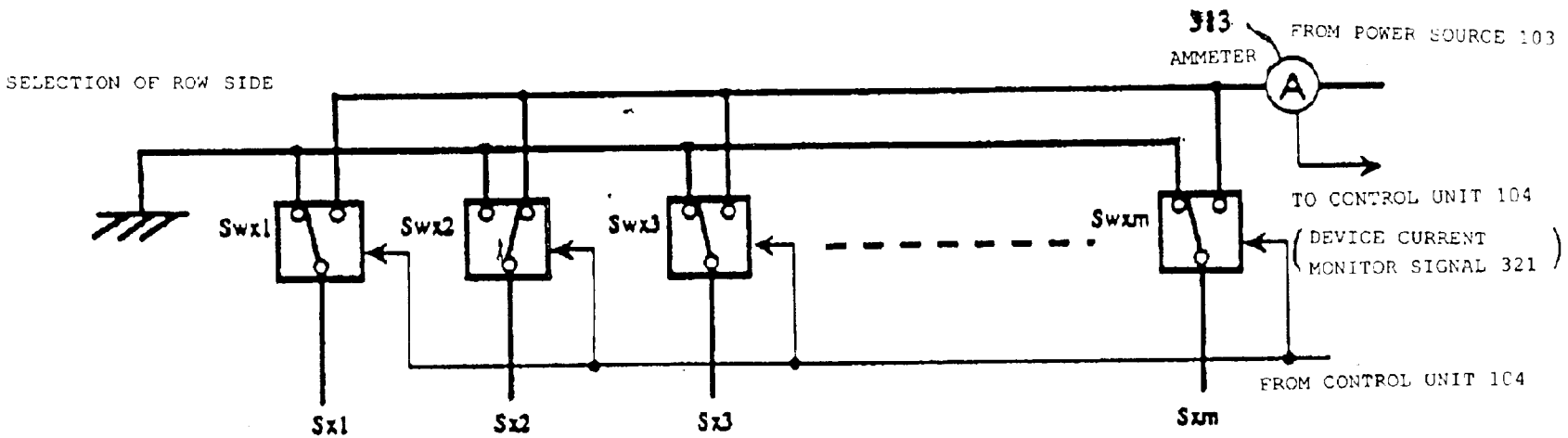
FIG. 2 is a circuit diagram of a row selection circuit provided to the energization activation process apparatus shown in FIG. 1.

Next, the operation of the row selection circuit 102 will be described using FIG. 2. FIG. 2 is a circuit diagram showing a circuit configuration of the row selection circuit 102.

The row selection circuit 102 has switches such as relays or analog switches. M switches SWx1 to SWxm are provided in parallel. The outputs of the respective switches are connected with the row wiring terminals Dx1 to Dxm of the electron source substrate 101, respectively.

These switches are controlled in accordance with control signals from the control unit 104 and operate so as to apply a voltage waveform from the power source 103 to a row wiring to be driven. In FIG. 2, a line of the second row (Dx2) is selected so that a voltage is applied to only the row wiring terminal Dx2 and the other lines (non-selection row wirings) are connected with a ground.

FIG. 19 is a schematic diagram for explaining voltage application in this embodiment.

In the drawing, the case where only the second row devices are connected with row side drive voltage sources and the other row devices are connected with a ground is shown.

Also, the devices are connected with column side drive voltage sources on the column side.

Hereinafter, with respect to the energization activation method in this embodiment, a voltage applying method will be described after the description of a partial pressure controlling method.

Figures 3A, 3B:
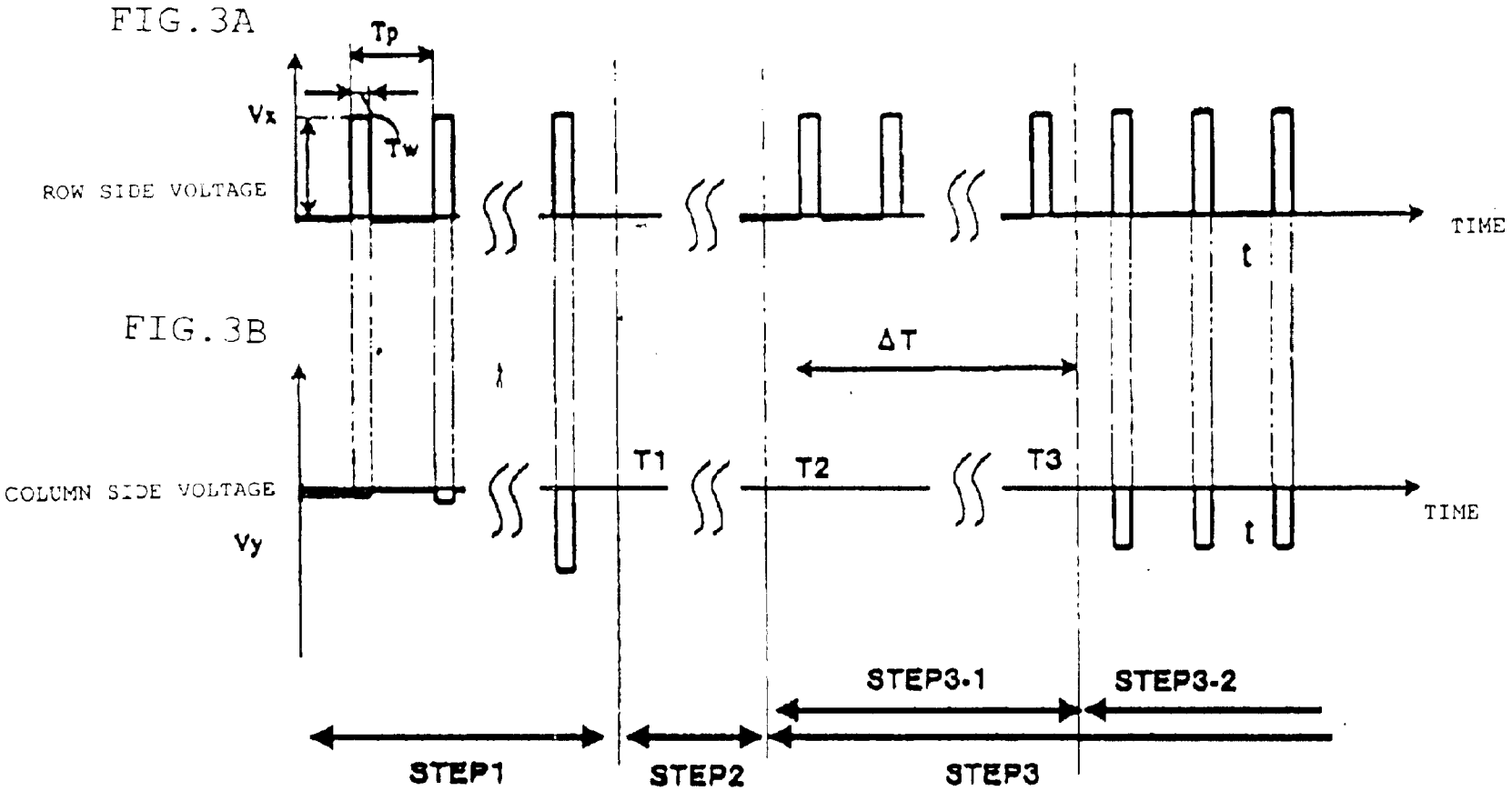
FIGS. 3A and 3B show explanatory charts of a drive sequence in a method of manufacturing an electron source according to a first embodiment of the present invention.

An applied waveform at activation processing is produced such that a voltage peak value Vx is 14 V, a pulse width Tw is 1 msec, and a pulse interval Tp is 10 msec (see FIG. 3A).

A voltage outputted from a column side is shown in FIG. 3B. Here, FIG. 3B shows a voltage outputted from a 1900th column side wiring. A voltage value applied from the column side is determined by the above calculation method.

Also, when a device current value of a row which is obtained from the above ammeter 313 (see FIG. 2) is saturated, the activation processing is completed.

First, "a multi-stage partial pressure adjustment energization activation method" will be described with reference to FIG. 4.

In this embodiment, an energization activation method of changing an activation gas partial pressure at two stages is conducted.

In this embodiment, tolunitrile is used as an activation gas, partial pressure at a first stage is set to $1\times10^{-2}$ Pa (P1), and partial pressure at a second stage is set to $2\times10^{-4}$ Pa (P2).

Also, an activation completion time at the first stage is set to 2 minutes (T1) and an activation start time at the second stage is set to 3 minutes (T2). A period required for switching from the first stage to the second stage is determined based on an exhaust capacity of a vacuum exhaust apparatus and an activation gas introducing method.

Further, a compensation voltage stop period ΔT is set to 3 minutes.

Next, the voltage applying process will be described.

In this embodiment, a method of applying 14 V from a row wiring and applying a compensation voltage for compensating voltage drop by a wiring resistance of the row wiring from a column wiring side is used.

In this embodiment, a resistance 78 between the devices of the row wiring (see FIG. 19, r0) is 1 mΩ. Assume that the resistance between the devices of the column wiring is extremely small and can be neglected.

The compensation voltage is outputted as follows. That is, a current flowing at energization activation is measured one time per second by the current detecting unit for a row wiring, a compensation voltage value is calculated based on the current value, and a voltage is outputted from the column side.

Note that the calculation method is already described and therefore the description is omitted here.

At the second stage of the partial pressure, a profile of a device current If is saturated after 15 minutes are elapsed from the start of activation (T3=18 minutes) so that a current value becomes about 5 A. Thus, the activation is completed.

As ΔT used here, a period for which a change in current is large at the beginning of the second stage is estimated in advance from experiments.

A drive sequence will be described using FIGS. 3A and 3B and 4.

(Step 1)

Figure 4:
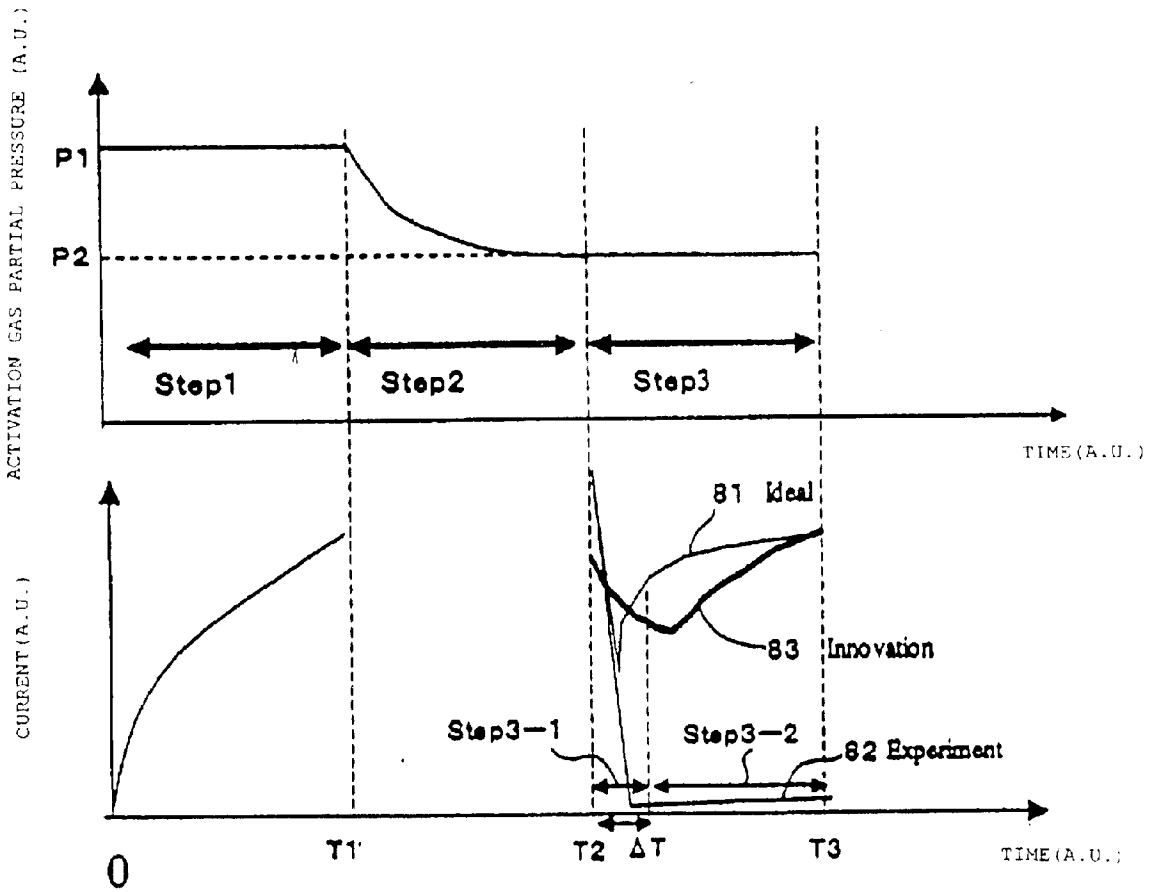
FIG. 4 shows an explanatory graph of the drive sequence in the method of manufacturing the electron source according to the first embodiment of the present invention.

The device current of the second row is increased from the start of energization as shown in FIG. 4. Thus, a voltage applied from the column side is also increased from the start of energization.

(Step 2)

The activation at the first stage is completed after 2 minutes are elapsed from the start of activation. Thus, output voltages from the row side and the column side are cut off and an activation gas partial pressure is changed.

(Step 3-1)

After the activation gas partial pressure is set for activation at the second stage, the application of a voltage is restarted from the row wiring. Note that the compensation voltage is not applied for the period ΔT.

(Step 3-2)

After the period ΔT is elapsed, the application of the compensation voltage is restarted.

When the device current is sufficiently saturated, the drive is finished and the activation process is completed.

When the method of this embodiment is used, the device current profile in this embodiment becomes a profile 83 shown in FIG. 4.

According to the profile 83, the device is not suddenly deteriorated as compared with the profile 82. In addition, an ultimate current which is substantially the same as an ideal device current profile 81 is obtained.

When the energization activation process for the second row is completed and then the energization activation process is conducted in succession for the row wirings except for the second row, an energization activation process in which the deterioration of device characteristics due to an overvoltage is not caused can be conducted.

Therefore, an electron source having high uniformity can be obtained.

According to this embodiment, the compensation voltage at the beginning of the second or more stage is not outputted for a predetermined period so that the application of an overvoltage to the devices is suppressed. However, the present invention is not limited to this.

For example, when a method of measuring the device current from the row wiring, conducting monitoring for a period for which it is suddenly changed, and stopping the application of the compensation voltage for the period is used, it is also preferably embodied.

Also, instead of the compensation voltage, a voltage applied to a single row wiring may be limited.

Also, the output of the compensation voltage is not completely stopped, but a compensation voltage of a value smaller than that of a normally compensated voltage may be outputted. In this case, a compensation voltage of a predetermined value may be outputted. Alternatively, a value calculated from a value of a current flowing through the electron emitting devices which is measured in advance may be used for the compensation voltage.

It can be considered that the above period for which the device current at the beginning of the second or more stage is suddenly changed is a period for which the device current is decreased. Thus, a method of stopping the output of the compensation voltage while time differential of the device current is "negative" is preferably embodied.

In this embodiment, the activation is conducted based on the activation completion condition in which the saturation of the activation current is detected. However, the present invention is not limited to this. For example, when a method of conducting measurement from a profile characteristic of an emission current Ie, a method of conducting measurement from a profile characteristic of efficiency η (=Ie/If), a method of conducting measurement from a characteristic between a device current If and an applied voltage V during activation, a characteristic between an emission current Ie and an applied voltage V, and a characteristic between efficiency η and an applied voltage V, or the like is used, it is also preferably embodied.

In this embodiment, the energization method of performing the application for the row wiring from both sides is conducted. However, the present invention is not limited to this. When an energization method of performing the application from one side is used, it is also preferably embodied.

Also, in this embodiment, the method of correcting the influence of voltage drop in the row wiring by the application of the voltage from the column wirings is employed in the "compensation voltage applying process". However, the present invention is not limited to this. When a voltage application method in which the row and the column are switched is used, it is also preferably embodied.

In this embodiment, the method of changing the activation gas partial pressure at two stages is used in the "multistage partial pressure adjustment energization activation method". However, the present invention is not limited to this. The number of stages is preferably changed as appropriate according to a device film material and an activation gas material. Thus, when it is divided into three or more stages, it is preferably embodied.

In this embodiment, the method of sequentially calculating the compensation voltage output value during the energization activation process is described. However, the present invention is not limited to this. Voltages to be outputted may be set based on the device current value measured in advance at the activation.

Also, the number of row wirings to be selected (the number of selection wirings) is not limited to one, and a plurality of row wirings may be simultaneously selected. Note that, at this time, a correct voltage value is preferably calculated by averaging wiring resistances of the plurality of simultaneously selected row wirings and resistances of devices connected therewith.

Second Embodiment

In the embodiment of the present invention, a method of conducting energization activation for a large number of devices for a short time is used in the case where the "energization time distributed activation process" and the "compensation voltage applying process" are simultaneously performed. In addition, this embodiment is characterized in that a compensation voltage at the start of energization is not outputted for a predetermined period. When this method is used, as compared with a conventional activation method, uniform activation processing can be performed and an electron source having a uniform emission current characteristic can be obtained.

Hereinafter, for simple description, contents different from the above first embodiment will be mainly described.

An activation processing control apparatus according to this embodiment has the same configuration as in the above first embodiment and therefore the description is omitted here.

In this embodiment, as the method of activating a large number of devices, a row unit activation process in which an activation process is performed row by row is conducted. In addition, according to this embodiment, a "time distributed energization activation method" is used for devices of 1024 rows of a first row to a 1024th row.

Hereinafter, as to the energization activation method in this embodiment, a voltage applying method will be described after the description of a partial pressure controlling method.

First, the partial pressure control will be described with reference to FIG. 6.

Tolunitrile is used as an activation gas and a set partial pressure value P0 is set to $5\times10^{-3}$ Pa. A row wiring for which energization activation is conducted is switched at intervals of 5 minutes (Tcycle). Then, for 1 minute (=ΔT2) immediately after switching of the row wiring, the compensation voltage is not applied from the column side. As ΔT2 used here, a period for which a change in current is large at the beginning of the second or more stage is estimated in advance from experiments.

Next, the voltage applying process will be described.

In this embodiment, a method of applying 14 V from a row wiring and for compensating voltage drop due to a wiring resistance from a column wiring side is used. In addition, according to this embodiment, a resistance 78 between the device of the row wiring (see FIG. 19, r0) is 1 mΩ. Assume that the resistance between the devices of the column wiring is extremely small and can be neglected.

The compensation voltage is outputted as follows. That is, a current flowing at energization activation is measured one time per second by the current detecting unit for a row wiring, a compensation voltage value is calculated based on the current value, and a voltage is outputted from the column side.

Note that the calculation method of the compensation voltage value is described above.

Figures 5A, 5B:
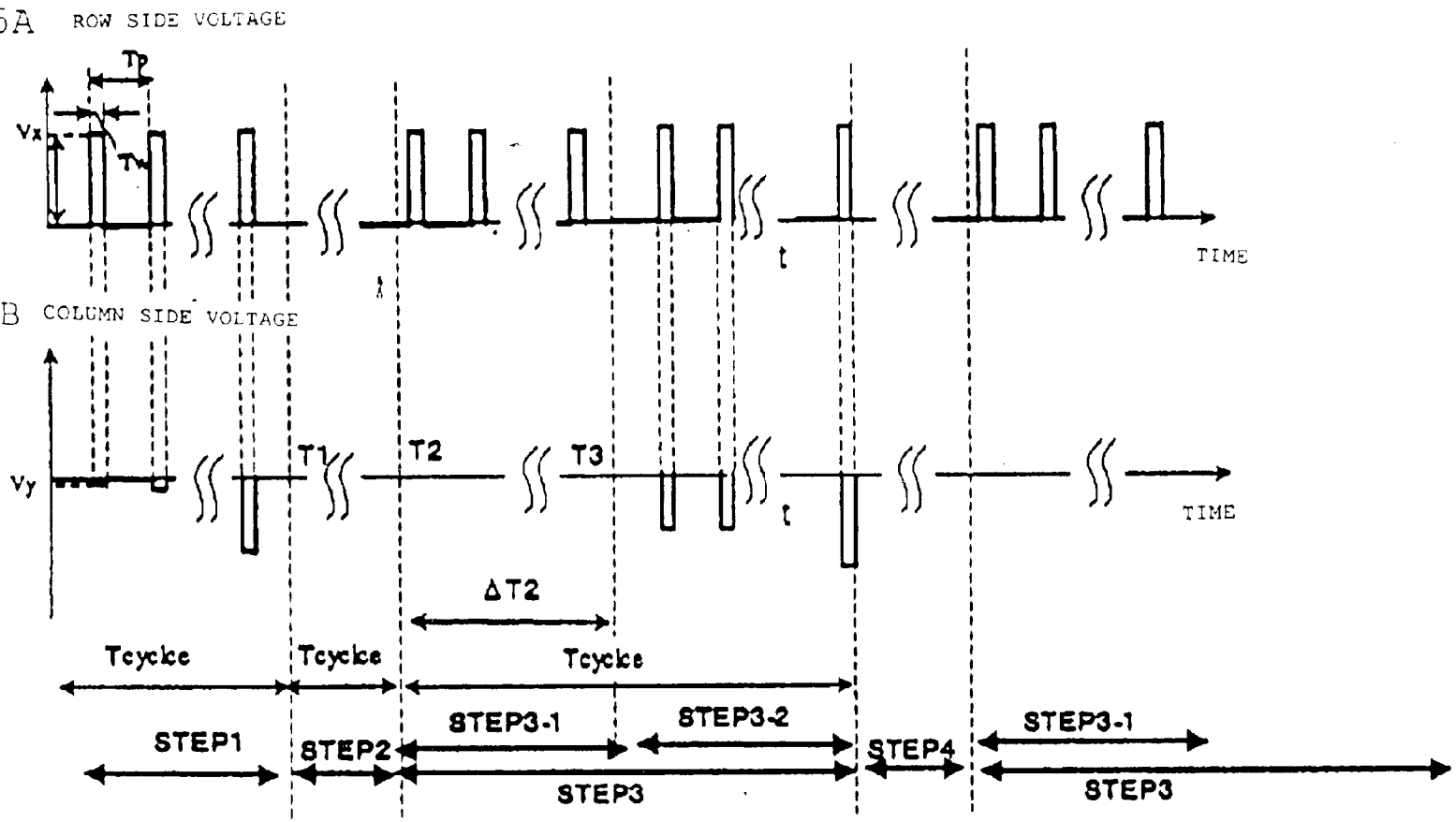
FIGS. 5A and 5B show explanatory charts of a drive sequence in a method of manufacturing an electron source according to a second embodiment of the present invention.

An applied waveform at activation processing is produced such that a voltage pulse height value V is 14 V, a pulse width is 1 msec, and a pulse interval is 10 msec (FIG. 5A).

FIG. 5B shows a voltage outputted from a 1900th column side wiring. A voltage value applied from the column side is determined by the above calculation method.

Also, when a device current value of a row which is obtained from the above ammeter 313 (see FIG. 2) is saturated, the activation processing is completed.

A method of starting the activation processing from a first row, then driving a second row, a third row, . . . , and a 1024th row, and then driving the first row again is used.

A drive sequence will be described using FIGS. 5A and 5B and 6.

(Step 1)

Figure 6:
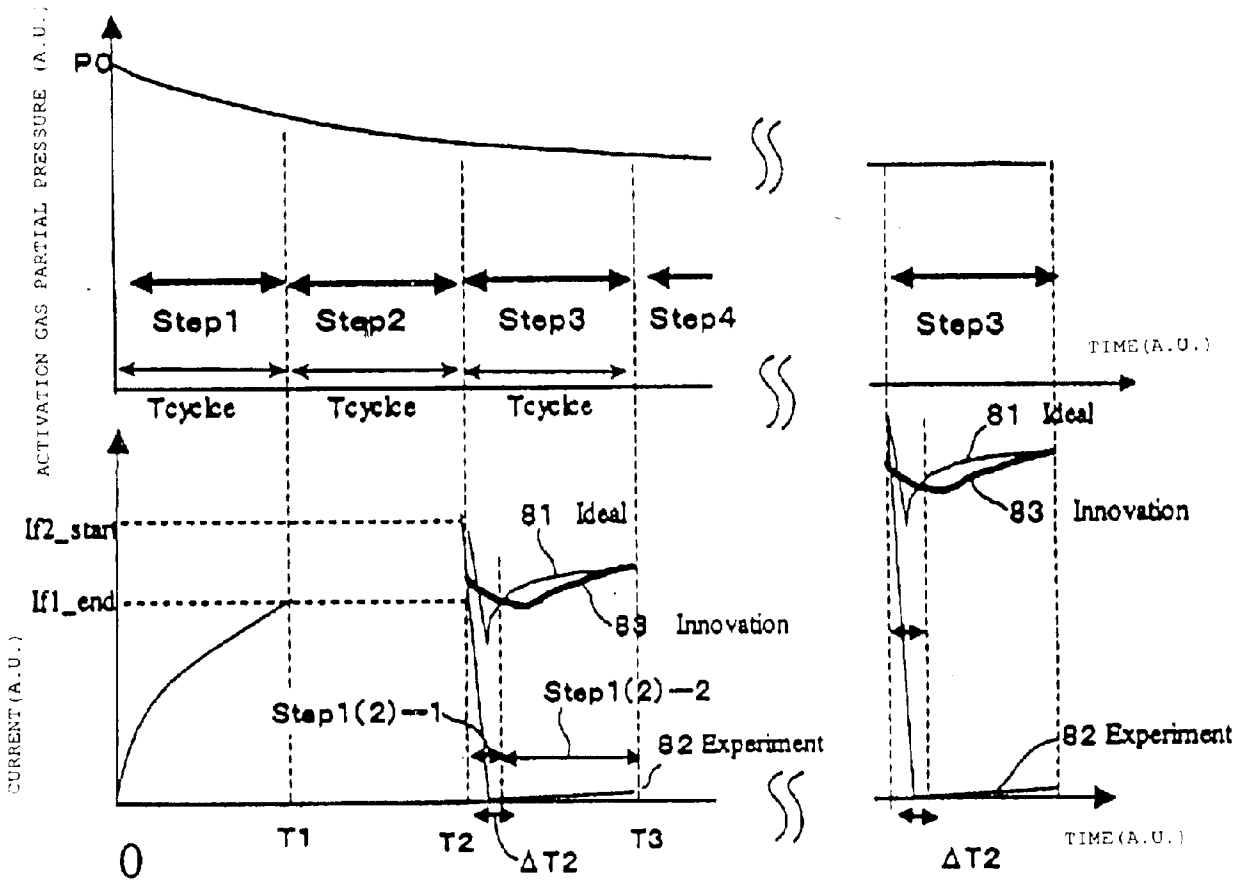
FIG. 6 shows an explanatory graph of the drive sequence in the method of manufacturing the electron source according to the second embodiment of the present invention.

The device current of the first row is increased from the start of energization as shown in FIG. 6. Thus, a voltage applied from the column side is also increased from the start of energization.

The activation at the first stage is completed after 5 minutes (=Tcycle) are elapsed from the start of activation. Thus, output voltages from the row side and the column side are cut off, the energization for the first row is completed, and the energization for the second row is prepared.

(Step 2)

In order to apply a voltage to the second row, only a switch for the second row in the row selection circuit 102 (see FIG. 1) is connected with SX2 and switches for all rows except the second row are connected with a ground. When the connection is completed, the energization is started.

The activation at the first stage is completed after 5 minutes (=Tcycle) are elapsed from the start of activation. Thus, output voltages from the row side and the column side are cut off and the energization for the second row is completed. Next, the energization for the third row is prepared. Hereinafter, the energization for each row is performed for 5 minutes (=Tcycle) up to the 1024th row.

(Step 3)

In order to apply a voltage to the first row again, only a switch for the first row in the row selection circuit 102 is connected with SX1 and switches for all rows except the first row are connected with a ground. When the connection is completed, the energization is started. Note that the compensation voltage is not applied for 1 minute (=ΔT2) from the column side. After the period ΔT2 is elapsed, the application of the compensation voltage is restarted.

The activation at the second stage is completed after 5 minutes are elapsed from the start of activation. Thus, output voltages from the row side and the column side are cut off and the energization for the first row is completed. Next, the energization for the second row is prepared.

(Step 4)

In order to apply a voltage to the second row again, only the switch for the second row in the row selection circuit 102 is connected with SX2 and switches for all rows except the second row are connected with a ground. When the connection is completed, the energization is started. Note that the compensation voltage is not applied for 1 minute (=ΔT2) from the column side. After the period ΔT2 is elapsed, the application of the compensation voltage is restarted.

The activation at the second stage is completed after 5 minutes are elapsed from the start of activation. Thus, output voltages from the row side and the column side are cut off and the energization for the second row is completed. Next, the energization for the third row is prepared.

Hereinafter, the same energization for each row is performed for 5 minutes (=Tcycle) up to the 1024th row.

The preparation for applying a voltage to the first row is started again.

In this embodiment, STEP 3 and STEP 4 are repeated to conduct the activation. When they are repeated 15 times, the saturation of the profile of the device current If is detected. Thus, the activation process is completed.

FIG. 6 shows the device current profile according to this embodiment.

When the method of this embodiment is used, the device current becomes the profile 83. According to the profile, the device is not suddenly deteriorated as compared with the profile 82. In addition, an ultimate current which is substantially the same as the ideal device current profile 81 is obtained.

When the energization activation process is performed for all devices of 1024 rows, an overvoltage is not applied during the activation process. Thus, an energization activation process in which the deterioration of device characteristics is not caused can be conducted. Therefore, an electron source having high uniformity can be obtained.

According to this embodiment, the compensation voltage at the beginning of the second or more stage is not outputted for a predetermined period so that the application of an overvoltage to the devices is suppressed. However, the present invention is not limited to this.

For example, when a method of measuring the device current from the row wiring, conducting monitoring for a period for which it is suddenly changed, and stopping the application of the compensation voltage for the period is used, it is also preferably embodied.

Also, instead of the compensation voltage, a voltage applied to a single row wiring may be limited.

Also, the output of the compensation voltage is not completely stopped, but a compensation voltage of a value smaller than that of a normally compensated voltage may be outputted. In this case, a compensation voltage of a predetermined value may be outputted. Alternatively, a value calculated from a value of a current flowing through the electron emitting devices which is measured in advance may be used for the compensation voltage.

It can be considered that the above period for which the device current at the beginning of the second or more stage is suddenly changed is a period for which the device current is decreased. Thus, a method of stopping the output of the compensation voltage while time differential of the device current is "negative" is preferably embodied.

In this embodiment, the activation is conducted based on the activation completion condition in which the saturation of the activation current is detected. However, the present invention is not limited to this. For example, when a method of conducting measurement from a profile characteristic of an emission current Ie, a method of conducting measurement from a profile characteristic of efficiency $\eta$ (=Ie/If), a method of conducting measurement from a characteristic between a device current If and an applied voltage V during activation, a characteristic between an emission current Ie and an applied voltage V, and a characteristic between efficiency $\eta$ and an applied voltage V, or the like is used, it is also preferably embodied.

In this embodiment, the energization method of performing the application for the row wiring from both sides is conducted. However, the present invention is not limited to this. When an energization method of performing the application from one side is used, it is also preferably embodied.

Also, in this embodiment, the method of correcting the influence of voltage drop in the row wiring by the application of the voltage from the column wirings is employed in the "compensation voltage applying process". However, the present invention is not limited to this. When a voltage application method in which the row and the column are switched is used, it is preferably embodied.

In this embodiment, the method of sequentially calculating the compensation voltage output value during the energization activation process is described. However, the present invention is not limited to this. Voltages to be outputted may be set based on the device current value measured in advance at the activation.

Also, as in the first embodiment, the number of row wirings to be selected (the number of selection wirings) is not limited to one, and a plurality of row wirings may be simultaneously selected. Note that, at this time, a correct voltage value is preferably calculated by averaging wiring resistances of the plurality of simultaneously selected row wirings and resistances of devices connected therewith.

As described above, when the electron source manufacturing method of the present invention is used, the activation processing can be uniformly performed for all thye electron emitting devices.

What is claimed is:

1. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of a selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, wherein the activation step includes a first activation step, a second activation step that is conducted after the first activation step, and a predetermined time interval separates the first and second activation steps, and wherein in the compensation voltage applying step, an operation for limiting the compensation voltage applied to the electron emitting devices connected with the selected wiring for a predetermined period from the beginning of the second activation step is conducted.

2. A method of manufacturing an electron source according to claim 1, wherein the operation for limiting the compensation voltage applied to the electron emitting devices for the predetermined period is conducted by controlling the compensation voltage.

3. A method of manufacturing an electron source according to claim 1, wherein in the operation for limiting the compensation voltage applied to the electron emitting devices for the predetermined period, the compensation voltage is set to a value smaller than a normally compensated voltage.

4. A method of manufacturing an electron source according to claim 1, wherein in the operation for limiting the compensation voltage applied to the electron emitting devices for the predetermined period, the compensation voltage is set to 0.

5. A method of manufacturing an electron source according to claim 1, wherein in the operation for limiting the compensation voltage applied to the electron emitting devices for the predetermined period, the compensation voltage is set to a predetermined value.

6. A method of manufacturing an electron source according to claim 1, wherein in the operation for limiting the compensation voltage applied to the electron emitting devices for the predetermined period, the compensation voltage is set to a value calculated from a value of a current flowing through the electron emitting devices which is measured in advance.

7. A method of manufacturing an electron source according to claim 1, wherein the predetermined period includes a period during which a device current of the electron emitting devices which is measured in advance is decreased.

8. A method of manufacturing an electron source according to claim 1, wherein the predetermined period includes a period during which a time differential value of a device current of the electron emitting devices is negative.

9. A method of manufacturing an electron source according to claim 1, wherein the compensation voltage is determined based on a variation in activation gas partial pressure.

10. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of a selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, and a step for switching at multi-stages a set value of an activation gas partial pressure, wherein in the compensation voltage applying step, an application of the compensation voltage is not conducted for a predetermined period after switching of the set value.

11. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of a selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, the compensation voltage applying step is repeated plural times while the selected wiring is switched and an application of the compensation voltage is not conducted for a predetermined period after switching of the selected wiring.

12. A method of manufacturing an electron source according to any one of claims 1, 10 and 11, wherein the compensation voltage is calculated based on a measurement value of a current flowing through the selected wiring.

13. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of the selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, wherein in the compensation voltage applying step, an operation for limiting the compensation voltage applied to the electron emitting devices connected with the selected wiring for a predetermined period is conducted, and wherein the predetermined period includes a period during which a device current of the electron emitting devices which is measured in advance is decreased.

14. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of a selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, wherein in the compensation voltage applying step, an operation for limiting the compensation voltage applied to the electron emitting devices connected with the selected wiring for a predetermined period is conducted, and wherein the predetermined period includes a period during which a time differential value of a device current of the electron emitting devices is negative.

15. A method of manufacturing an electron source including a plurality of row wirings, a plurality of column wirings, and a plurality of electron emitting devices each connected therewith, which are provided on a substrate, the method comprising:

a forming step of forming an electron emitting portion in each of the electron emitting devices; and an activation step of applying a voltage to the electron emitting devices in an activation gas atmosphere to deposit one of carbon and a carbon compound on a region including the electron emitting portion, wherein the activation step has a compensation voltage applying step of selecting part of either one of the row wirings and the column wirings, and determining a potential of a selected wiring so that, when the voltage is applied to all the electron emitting devices connected with the selected wiring, a compensation voltage for compensating for a voltage drop caused in the selected wiring is applied to the electron emitting devices connected with the selected wiring through another of the row wirings and the column wirings, wherein in the compensation voltage applying step, an operation for limiting the compensation voltage applied to the electron emitting devices connected with the selected wiring for a predetermined period is conducted, and wherein the compensation voltage is determined based on a variation in activation gas partial pressure.

* * * * *